US005288595A

United States Patent [19]

Watanabe et al.

[11] Patent Number: 5,288,595

[45] Date of Patent: Feb. 22, 1994

[54] METHOD FOR PROCESSING SILVER HALIDE PHOTOSENSITIVE MATERIAL

[75] Inventors: Harumi Watanabe; Tetsuro Kojima; Nobuo Watanabe, all of Minami-Ashigara, Japan

[73] Assignee: Fuji Photo Film Co., Ltd., Minami-Ashigara, Japan

[21] Appl. No.: 58,258

[22] Filed: May 10, 1993

[30] Foreign Application Priority Data

May 11, 1992 [JP] Japan ..... 4-143699

[51] Int. Cl.[5] ..... G03C 5/38; G03C 7/42

[52] U.S. Cl. ..... 430/393; 430/455; 430/460

[58] Field of Search ..... 430/393, 455, 460

[56] References Cited

U.S. PATENT DOCUMENTS

| | | | |
|---|---|---|---|
| H953 | 8/1991 | Goto et al. | 430/455 |
| 3,330,658 | 7/1967 | Gilman et al. | 430/233 |
| 3,721,157 | 3/1973 | Bacher | 409/138 |
| 4,631,253 | 12/1986 | Mifune et al. | 430/569 |
| 4,713,313 | 12/1987 | Bartels-Keith et al. | 430/455 |
| 5,120,635 | 6/1992 | Sasaki et al. | 430/393 |

FOREIGN PATENT DOCUMENTS

| | | |
|---|---|---|
| 2015455 | 4/1970 | France . |
| 57-202531 | 12/1982 | Japan . |
| 61-32845 | 2/1986 | Japan . |

*Primary Examiner*—Hoa Van Le

*Attorney, Agent, or Firm*—Burns, Doane, Swecker & Mathis

[57] ABSTRACT

A method for processing a silver halide photosensitive material comprises the steps of developing an exposed silver halide photosensitive material and treating it with a bath having a fixing function containing an N-oxide compound having a mercapto group in the molecule. When the bath having a fixing function is used, a stable fixing power and excellent desilverization effect can be obtained by processing a color photosensitive material with only a small amount of replenisher.

15 Claims, No Drawings

METHOD FOR PROCESSING SILVER HALIDE PHOTOSENSITIVE MATERIAL

BACKGROUND OF THE INVENTION

The present invention relates to a method for processing a silver halide photosensitive material, characterized by conducting the process in the presence of an N-oxide compound having at least one mercapto group in the molecule.

The processing of the silver halide color photosensitive material usually comprises a color developing step and a desilverization step. Silver formed by the development is oxidized with a bleaching agent and then dissolved with a fixing agent. An iron (III) ion complex salt such as an aminopolycarboxylic acid/iron (III) complex salt is mainly used as the bleaching agent and a thiosulfate is usually used as the fixing agent.

On the other hand, the processing of a black-and-white photosensitive material comprises a development step and a step for removing an unexposed silver halide. In this process, the photosensitive material is fixed without bleaching after the development unlike the processing of the color photosensitive material. Also in this case, a thiosulfate is usually used as the fixing agent.

As replenishers are recently being reduced in amount, a stable composition is required of each replenisher. As for a fixing bath, a sulfite is added as an antioxidative preservative to this bath in most cases, since the thiosulfate usually used is oxidized, deteriorated and sulfided to form a precipitate. Although further improvement in the stability of the liquids is desired as the reduction in amount of the replenishers is accelerated, the problems of the solubility and the formation of sodium sulfate precipitate formed by the oxidation of a sulfite are posed by increasing the amount of the sulfite to be added.

In addition, finding of a compound having a fixability higher than that of the thiosulfate is demanded from the viewpoint of acceleration. Under these circumstances, development of a fixing agent having excellent resistance to oxidation and fixability and usable as a substitute for the thiosulfates is demanded. However, no compound usable as an excellent substitute has been found yet.

As for the N-oxide compounds used in the present invention, for example, Japanese Patent Unexamined Published Application (hereinafter referred to as "J.P. KOKAI") No. Sho 61-32845 discloses that when an N-oxide compound is added to a developer, release of a photographic reagent is accelerated, U.S. Pat. No. 3,330,658 discloses that they are used as a color tone improver in diffusion transfer, and French patent No. 2,015,455 discloses that when an N-oxide compound is added to a silver halide emulsion, it exhibits an antifogging effect. However, the use of the N-oxide compounds as a solvent for silver halides and the use thereof in a fixing bath according to the present invention are novel and cannot be easily inferred from the above-described prior art.

SUMMARY OF THE INVENTION

Therefore, a primary object of the present invention is to provide an excellent fixing method.

Another object of the present invention is to provide a method for processing a silver halide photosensitive material wherein an improved stability of a bath containing a fixing agent and subsequent-baths are kept even when the amount of the replenisher is only small.

These and other objects of the present invention will be apparent from the following description and examples.

The above-described objects of the present invention have been attained by a method for processing a silver halide photosensitive material comprising the steps of developing an exposed silver halide photosensitive material and treating it with a bath having a fixing function contains an N-oxide compound having at least one mercapto group in the molecule.

DESCRIPTION OF THE PREFERRED EMBODIMENTS

It is preferable that the N-oxide compound be a compound represented by the folloing formula (1).

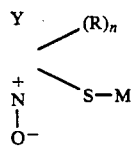

M in the general formula (1) represents a hydrogen atom; an alkali metal such as sodium or potassium; an alkaline earth metal such as magnesium or calcium; an ammonium group such as ammonium group per se or triethylammonium group. Y represents an atomic group necessitated for forming a five- to seven-membered heterocyclic ring, preferably a six-membered heterocyclic ring (such as pyridine, pyrimidine, pyridazine or triazine). Such a heterocyclic ring may be condensed with a saturated or unsaturated carbon ring or heterocyclic ring, and the condensed rings may have a substituent. R represents a substituent. The substituents include, for example, alkyl groups (such as methyl, ethyl, propyl, t-butyl and cyanoethyl groups), halogen atoms (such as bromine and chlorine atoms), hydroxyl group, alkoxy groups (such as methoxy and ethoxy groups), amino groups (such as unsubstituted amino, dimethylamino, diethylamino and methylamino groups), carbonamido groups (such as acetamido and benzamido groups), sulfonamido groups (such as methanesulfonamido, benzenesulfonamido and p-toluanesulfonamido groups), ureido groups (such as unsubstituted ureido, methylureido, ethylureido and phenylureido groups), thioureido groups (such as unsubstituted thioureido and methylthioureido groups), acyl groups (such as acetyl and benzoyl groups), carbamoyl groups (such as unsubstituted carbamoyl and phenylcarbamoyl groups), sulfamoyl groups (such as unsubstituted sulfamoyl, methylsulfamoyl and phenylsulfamoyl groups), oxycarbonyl groups (such as methoxycarbonyl and phenoxycarbonyl groups), carboxyl group, sulfonic group, sulfonyl groups (such as methanesulfonyl and benzenesulfonyl groups), cyano group, nitro group, aryl groups (such as phenyl, 4-methanesulfonamidophenyl, 4-methylbenzyl and naphthyl groups), aralkyl groups (such as benzyl, 4-methylbenzyl and phenethyl groups), alkenyl groups (such as allyl group), acyloxy groups (such as acetyloxy and benzoyloxy groups), sulfonyloxy groups (such as methanesulfonyloxy group), oxycarbonylamino groups (such as methoxycarbonylamino, phenoxycarbonylamino and 2-ethylhexyloxycarbonylamino groups).

Preferred substituents R include carboxyl group, sulfonic group, amino group and those containing such a group (for example, carboxymethyl group, carboxyethyl group, sulfomethyl group, sulfoethyl group, aminomethyl group, aminoethyl group, dimethylamino group, dimethylaminomethyl group and dimethylaminoethyl group).

n represents an integer of 0 to 5, preferably 0 or 1. When n is 1, R is preferably carboxyl group or sulfonic group. When n is an integer of 2 to 5, groups R may be the same or different.

It is preferable that the N-oxide compound have 3 to 20 carbon atoms, more preferably 3 to 10 carbon atoms.

The description will be made on examples of the compounds of the present invention, which by no means limit the invention.

1

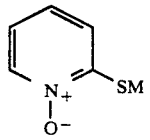

2

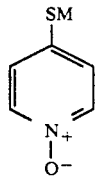

3

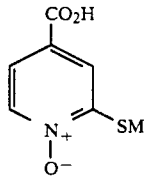

4

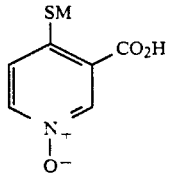

5

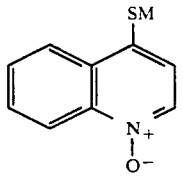

6

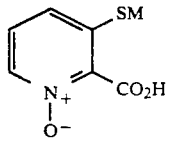

7

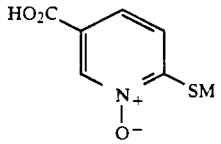

-continued

8

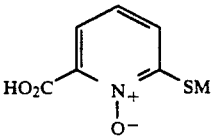

9

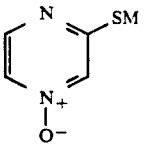

10

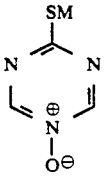

11

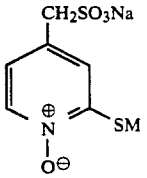

12

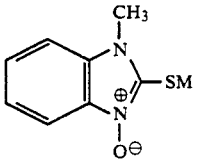

13

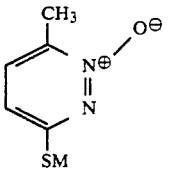

14

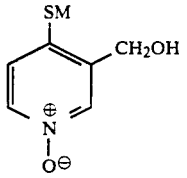

15

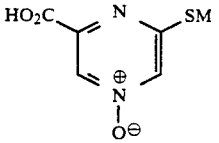

16

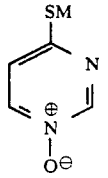

M = H, Na

The compounds used in the present invention can be synthesized by a method described in J.P. KOKAI No Sho 61-32845, methods described in R. A. Jones, A. R. Katritzky, Journal of Chemical Society, 2937 (1960); S. W. May, P. W. Mueller, C. D. Oldham, C. K. Williamson and A. L. Sowell, Biochemistry, 22, 5331 (1983); E. C. Taylor, J. S. Driscoll, Journal of the American Chemical Society, 82, 3141 (1961); Y. Suzuki, Journal of the Pharmaceutical Society of Japan, 81, 1151 (1961); B. Blank et al., Journal of Medical Chemistry, 17, 1065 (1974); and M. Bobek, A. Bloch, Journal of Medicine Chemistry, 16, 183 (1972), as well as synthesis examples given below.

Synthesis Example 1

2.0 g of 4-chloropyridine 1-oxide and 1.55 g of thiourea were heated under reflux in 30 ml of ethanol for 1 hour. After cooling, precipitates thus formed were taken by filtration to obtain 2.3 g of s-4-pyridylisothiouronium chloride 1-oxide. 1.25 g of this product was stirred together with 0.38 g of sodium hydroxide and 12.5 ml of water for 4 hours and then the mixture was acidified with hydrochloric acid to obtain a N-oxide compound-2 described above. This compound was recrystallized from water/ethanol. The yield and melting point were 0.8 g and 138° to 140° C., respectively. From NMR, IR and elementary analysis, the product was identified with the intended compound.

Synthesis Example 2

4-Chloroisonicotinic acid 1-oxide and thiourea were heated under reflux in ethanol for 1 hour. After cooling, precipitates thus formed were taken by filtration to obtain s-2-isonicotinic acid isothiouronium chloride 1-oxide. This product was treated in an aqueous sodium hydroxide solution for 4 hours and then acidified with hydrochloric acid to obtain a N-oxide compound-3 described above. This compound was recrystallized from water and dried under reduced pressure. The melting point was 166° C. (decomp.). By NMR, IR and elementary analysis, the structure of this product was confirmed.

The N-oxide compounds are usable for, for example, an image-forming process with a silver halide photosensitive material.

When the N-oxide compound is added to a processing solution having a fixing function (such as fixing solution or bleach-fixing solution), the amount of the compound is preferably $1\times10^{-4}$ to 1 0 mol/l, more preferably $1\times10^{-3}$ to 5 mol/l and most preferably $1\times10^{-3}$ to 3 mol/l. When the N-oxide compound is added to a processing solution having a fixing function (such as fixing solution or bleach-fixing solution), the solution is not easily deteriorated by oxidation unlike thiosulfuric acid heretofore used as a fixing agent and, in addition, the excellent characteristic fixing function can be exhibited. The N-oxide compound can be added also to a subsequent-bath (such as stabilizer and washing water) used after the processing solution having fixing function.

The amount of the compound of the present invention used in the fixing bath is preferably $1\times10^{-4}$ to 10 mol/l, more preferably $1\times10^{-3}$ to 5 mol/l and most preferably $\times10^{-2}$ to 3 mol/l. When the N-oxide compound is used in the bleach-fixing bath. the amount of the compound is preferably $2\times10^{-2}$ to 10 mol/l, more preferably $2\times10^{-1}$ to 3 mol/l.

When the halogen composition of the silver halide emulsion in the photosensitive material to be processed comprises AgBrI (preferably AgI≧1 molar %, more preferably AgI=2 to 15 molar %), the N-oxide compound is used in an amount of preferably 0.5 to 2 mol/l, more preferably 1.2 to 2 mol/l. When the halogen composition comprises AgBr or AgBrCl or it has a high silver chloride content (AgCl≧80 molar %), the compound of the present invention is used in an amount of preferably $2\times10^{-1}$ to 1 mol/l.

The detailed description will be made on the silver halide photosensitive material for color photography and a method for processing it. Some parts of the description is applicable also to black-and-white photosensitive materials.

The minimum requirement of the silver halide photosensitive material for color photography of the present invention is that it comprises at least one of blue-sensitive, green-sensitive and red-sensitive silver halide emulsion layers formed on a support. The number and order of the arrangement of the silver halide emulsion layers and photoinsensitive layers are not particularly limited. A typical example is a silver halide photosensitive material comprising at least one photosensitive layer composed of silver halide emulsion layers having substantially the same color sensitivity but different degree of sensitivity. This is a unit photosensitive layer sensitive to any of blue, green and red lights. In multilayer silver halide photosensitive materials for color photography, the arrangement of the unit photosensitive layers are usually red-sensitive layer, green-sensitive layer and blue-sensitive layer in order from a support. However, according to the purpose, a reverse order is also possible or a photosensitive layer sensitive to a color can be interposed between photosensitive layers sensitive to another color.

A photoinsensitive layer such as an intermediate layer can be provided between the silver halide photosensitive layers or as the top layer or the lowermost layer.

The intermediate layer may contain a coupler, DIR compound, etc. which are described in J.P. KOKAI Nos. Sho 61-43748, 59-113438, 59-13440, 61-20037 and 61-20038 and an ordinary color mixing inhibitor.

As the silver halide emulsion layers constituting the unit photosensitive layer, a two-layer structure composed of a high-speed emulsion layer and a low-speed emulsion layer such as that described in West German Patent No. 1,121,470 or British Patent No. 923,045 is preferably usable. The arrangement is usually preferably such that the sensitivities of the layers are gradually lowered toward the support. A photoinsensitive layer may be provided between the halogen emulsion layers. It is also possible that a low-speed emulsion layer is arranged on a side remote from the support and a high-speed emulsion layer is arranged close to the support as described in J.P. KOKAI Nos. Sho 57-112751, 62-200350, 62-206541 and 62-206543.

The arrangement of the layers can be a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), BH/BL/GL/GH/RH/RL or BH/BL/GH/GL/RL/RH in order toward the support.

The arrangement of the layers can be also a blue-sensitive layer /GH/RH/GL/RL toward the support as described in Japanese Patent Publication for Opposition Purpose (hereinafter referred to as "J.P. KOKOKU") No. Sho 55-34932. Further, the arrangement of the layers can be a blue-sensitive layer /GL/RL/GH/RH toward the support as described in J.P. KOKAI Nos. Sho 56-25738 and 62-63936.

In another arrangement of the layers which comprises three layers having sensitivities different from one another, the top layer comprises a silver halide emulsion layer having the highest sensitivity, the intermediate layer comprises a silver halide emulsion layer having a lower senstivity and the bottom layer comprises a silver halide emulsion layer having a still lower sensitivity so that the sensitivities of the layers are gradually lowered toward the support. Also in such a structure comprising three layers sensitive to the same color and having degrees of sensitivity different from one another, the arrangement may be medium-speed emulsion layer/high-speed emulsion layer/low-speed emulsion layer toward the support as described in J.P. KOKAI No. Sho 59-202464.

Thus various layer structures and arrangements are possible depending on the purpose of the photosensitive material.

When the silver halide photosensitive material for color photography is a negative color film or reversal color film, the preferred silver halide contained in the photographic emulsion layer is silver bromoiodide, silver chloroiodide or silver chlorobromoiodide containing less than about 30 molar % of silver iodide. Particularly preferred is silver bromoiodide or silver chlorobromoiodide containing about 2 to 25 molar % of silver iodide.

When the silver halide photosensitive material for color photography is a color photographic printing paper, the silver halide contained in the photographic emulsion layer thereof is preferably silver chlorobromide or silver chloride containing substantially no silver iodide. The term "containing substantially no silver iodide" as used herein indicates that the silver iodide content is 1 molar % or less, preferably 0.2 molar % or less. As for the halogen commposition of the silver chlorobromide emulsions, any silver bromide/silver chloride composition is usable. Although the ratio of silver bromide/silver chloride can be selected depending on the purpose in a wide range, a silver chloride content of at least 2 molar % is preferred. To produce a photosensitive material suitable for rapid process, an emulsion having a high silver chloride content is preferably used. The silver chloride content of such a high-silver chloride emulsion is preferably at least 90 molar %, still preferably at least 95 molar %. A substantially pure silver chloride emulsion having a silver chloride content of 98 to 99.9 molar % is also preferably used for the purpose of reducing the amount of the developing replenisher.

The silver halide grains in the photographic emulsion may be in a regular crystal form such as cubic, octahedral or tetradecahedral form or an irregular crystal form such as spherical or tabular form. They may have a crystal defect such as a twin plane, or they may be in a complex crystal form thereof.

The grain diameter of the silver halide may be as small as about 0.2 μm or below or as large as that the diameter of the projection area thereof is up to about 10 μm. The emulsion may be either a polydisperse emulsion or monodisperse emulsion.

The photographic silver halide emulsion usable in the present invention can be prepared by a method described in, for example, Research Disclosure (hereinafter referred to as "RD") No. 17643 (December, 1978), pages 22 to 23, "I. Emulsion preparation and types)", or No. 18716 (November, 1979), page 648. Monodisperse emulsions described in U.S. Pat. Nos. 3,574,628 and 3,655,394 and British Patent No. 1,413,748 are also preferred.

Tabular grains having an aspect ratio of about 5 or above are also usable in the present invention. The tabular grains can be easily prepared by a method described in, for example, Gutoff, Photograhic Science and Engineering, Vol. 14, pages 248 to 257 (1970); U.S. Pat. Nos. 4,434,226, 4,414,310, 4,433,048 and 4,439,520; and British Patent No. 2,112,157.

As for the crystal structure, it may be homogeneous; it may be composed of a core and shell having halogen compositions different from each other; or it may be a laminar structure. Silver halides different from each other can be conjugated with each other by epitaxial junction. Further, the silver halides can be conjugated with a compound other than the silver halides such as silver rhodanide or lead oxide.

A mixture of grains having various crystal forms is also usable.

The silver halide emulsion is usually used after physical aging, chemical sensitization and spectral sensitization. In the course of the physical aging, various polyvalent metal ion impurities (such as salts or complex salts of cadmium, zinc, lead, copper, thallium, iron, ruthenium, rhodium, palladium, osmium, iridium and pltinum) can be incorporated into the emulsion. The compounds usable for the chemical sensitization include those described from right lower column, page 18 to right upper column, page 22 of J.P. KOKAI No. Sho 62-215272. The additives usable in such a step are described in RD Nos. 17643 and 18716. The portions in which the additives are mentioned in these two RD's are summarized in the following table. Known photographic aditives usable in the present invention are also mentioned in the two RD's, and the corresponding portions are also given in the following table.

| Additive | RD 17643 | RD 18716 |
|---|---|---|
| 1. Chemical sensitizer | p. 23 | right column, p. 648 |
| 2. Sensitivity improver | | right column, p. 648 |
| 3 Spectral sensitizer and supersensitizer | pp. 23 to 24 | right column, p. 648 to right column, p. 649 |
| 4 Brightening agent | p. 24 | |
| 5 Antifoggant and stabilizer | pp. 24 and 25 | from right column, p. 649 |
| 6 Light absorber, filter dye and ultraviolet absorber | pp. 25 to 26 | right column, p. 649 to left column, p. 650 |
| 7 Antistaining agent | right column, p. 25 | left and right columns, p. 650 |
| 8 Dye image stabilizer | p. 25 | |
| 9 Hardener | p. 26 | left column, p. 651 |
| 10 Binder | p. 26 | left column, p. 651 |
| 11 Plasticizer and lubricant | p. 27 | right column, p. 650 |
| 12 Coating aid and surfactant | pp. 26 to 27 | right column, p. 650 |
| 13 Antistatic agent | p. 27 | right column, p. 650 |

It is desirable to incorporate a compound capable of reacting with formaldehyde to fix it which is described in U.S. Pat. Nos. 4,411,987 and 4,435,503 into the photosensitive material in order to prevent the photographic properties from deterioration by gaseous formaldehyde.

Various color couplers are usable in the present invention. Examples of them are disclosed in patents described in the above-described RD No. 17643, VII-C to G.

Preferred yellow couplers are those described in, for example, U.S. Pat. Nos. 3,933,501, 4,022,620, 4,326,024, 4,401,752 and 4,248,961; J.P. KOKOKU No. Sho 58-10739; British Patent Nos. 1,425,020 and 1,476,760; U.S. Pat. Nos. 3,973,968, 4,314,023 and 4,511,649; and European Patent No. 249,473 A.

Preferred magenta couplers are 5-pyrazolone and pyrazoloazole compounds, and particularly preferred are those described in, for example, U.S. Pat. Nos. 4,310,619 and 4,351,897; European Patent No. 73,636; U.S. Pat. Nos. 3,061,432 and 3,725,064, RD No. 24220 (June, 1984); J.P. KOKAI No. Sho 60-33552, RD No. 24230 (June, 1984); J.P. KOKAI Nos. Sho 60-43659, 61-72238, 60-35730, 55-118034 and 60-185951; U.S. Pat. Nos. 4,500,630, 4,540,654 and 4,556,630; and WO (PCT) 88/04795.

Cyan couplers include phenol and naphthol couplers. Preferred are those described in, for example, U.S. Pat. Nos. 4,052,212, 4,146,396, 4,228,233, 4,296,200, 2,369,929, 2,801,171, 2,772,162, 2,895.826, 3,772,002, 3,758,308, 4,334,011 and 4,327,173; West German Patent Unexamined Published Application (hereinafter referred to as "West German KOKAI") No. 3,329,729, European Patent Nos. 121,365 A and 249,453 A; U.S. Pat. Nos. 3,446,622, 4,333,999, 4,753,871, 4,451,559, 4,427,767, 4,690,889, 4,254,212 and 4,296,199; and J.P. KOKAI No. Sho 61-42658.

Preferred colored couplers used for compensating unnecessary absorption of colored dyes are those described in RD No. 17643, VII-G; U.S. Pat. No. 4,163,670; J.P. KOKOKU No. 57-39413; U.S. Pat. Nos. 4,004,929 and 4,138,258; and British Patent No. 1,146,368. It is also preferred to use a coupler described in U.S. Pat. No. 4,774,181 which compensates unnecessary absorption of a colored dye with a fluorescent dye released upon the coupling; or a coupler having a dye precursor group, as a split-off group, capable of forming a dye upon reaction with a developing agent described in U.S. Pat. No. 4,777,120.

As the couplers capable of forming a colored dye having a suitable diffusibility, those described in U.S. Pat. No. 4,366,237, British Patent No. 2,125,570, European Patent No. 96,570 and West German KOKAI No. 3,234,533 are preferred.

Typical examples of polymerized dye-forming couplers are described in, for example, U.S. Pat. Nos. 3,451,820, 4,080,211, 4,367,282, 4,409,320 and 4,576,910 and British patent No 2,102,173.

Couplers capable of releasing a photographically useful residue upon the coupling are also preferably usable in the present invention. DIR couplers which release a development inhibitor are preferably those described in the patents mentioned in the above-described RD 17643, VII-F, J.P. KOKAI Nos. Sho 57-151944, 57-154234, 60-184248 and 63-37346, and U.S. Pat. Nos. 4,248,962 and 4,782,012.

Couplers capable of releasing a nucleating agent or development accelerator in the development step are preferably those described in British Patent Nos. 2,097,140 and 2,131,188 and J.P. KOKAI Nos. 59-157638 and 59-170840.

Other couplers usable for producing the photosensitive material of the present invention include competing couplers described in, for example, U.S. Pat. No 4,130,427; polyequivalent couplers described in U.S. Pat. Nos. 4,283,472, 4,338,393, 4,310,618, etc.; DIR redox compound-releasing couplers, DIR coupler-releasing couplers, DIR coupler-releasing redox compounds and DIR redox-releasing redox compounds described in J.P. KOKAI Nos. Sho 60-185950, 62-24252, etc.; couplers capable of releasing a dye which restores the color after the release described in European Patent No. 173,302 A; bleach accelerator-releasing couplers described in RD Nos. 11449 and 24241 and J.P. KOKAI No. Sho 61-201247, etc.; ligand-releasing couplers described in, for example, U.S. Pat. No. 4,553,477; leuco dye-releasing couplers described in J.P. KOKAI No. 63-75747; and fluorescent dye-releasing couplers described in U.S. Pat. No. 4,774,181.

The couplers used in the present invention can be incorporated into the photosensitive material by various known dispersion methods. Examples of high-boiling solvents usable in an oil-in-water dispersion method are described in, for example, U.S. Pat. No. 2,322,027. Examples of the high-boiling organic solvents having a boiling point of 175° C. or above under atmospheric pressure and usable in the oil-in-water dispersion method include phthalic esters [such as dibutyl phthalate, dicyclohexyl phthalate, di-2-ethylhexyl phthalate, decyl phathalate, bis(2,4-di-t-amylphenyl) phthalate, bis(2,4-di-t-amylphenyl) isophthalate and bis(1,1-diethylpropyl) phthalate], phosphoric and phosphonic esters (such as triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic esters (such as 2-ethylhexyl benzoate, dodecyl benzoate and 2-ethylhexyl p-hydroxybenzoate), amides (such as N,N-diethyldodecaneamide, N,N-diethyllaurylamide and N-tetradecylpyrrolidone), alcohols and phenols (such as isostearyl alcohol and 2,4-di-tert-amylphenol), aliphatic carboxylic esters [such as bis(2-ethylhexyl) sebacate, dioctyl azelate, glycerol tributyrate, isostearyl lactate and trioctyl citrate), aniline derivatives (such as N,N-dibutyl-2-butoxy-5-tert-octylaniline) and hydrocarbons (such as paraffin, dodecylbenzene and diisopropylnaphthalene). As assistant solvents, organic solvents having a boiling point of above about 30° C., preferably about 50° to 160° C. are usable. Typical examples of them include ethyl acetate, butyl acetate, ethyl propionate, methyl ethyl ketone, cyclohexanone, 2-ethoxyethyl acetate and dimethylformamide.

The steps of latex dispersion method, effect thereof and examples of latexes for impregnation are described in, for example, U.S. Pat. No. 4,199,363 and West German Patent Application (OLS) Nos. 2,541,274 and 2,541,230.

Such a coupler can be emulsion-dispersed in an aqueous hydrophilic colloid solution by impregnating a loadable latex polymer (see, for example, U.S. Pat. No. 4,203,716) with the coupler in the presence or absence of the above-described high-boiling organic solvent or by dissolving the coupler in a polymer insoluble in water but soluble in an organic solvent.

Homopolymers or copolymers described on pages 12 to 30 of the specification of International Publication No. WO 088/00723 are preferably used. The use of acrylamide polymers are particularly desirable for color image stabilization.

The supports suitable for use in the present invention are described in, for example, the above-mentioned RD No. 17643, p. 28 and No. 18716, (from right column, p. 647 to left column, p. 648).

The total thickness of the whole hydrophilic colloid layers of the photosensitive material of the present invention is 25 mμ or below, preferably 20 mμ or below. The swelling rate $T_{\frac{1}{2}}$ of the film is preferably 30 sec or below (still preferably 15 sec or below). The film thickness herein indicates the thickness of the film determined at 25° C. at a relative humidity controlled at 55% (2 days). The swelling rate of the film $T_{\frac{1}{2}}$ can be determined by a method well known in the art. For example, it can be determined with a swellometer described by A. Green etc. in Photogr. Sci. Eng., Vol. 19, No. 2, pp. 124 to 129. $T_{\frac{1}{2}}$ is defined as follows: 90% of the maximum swollen film thickness obtained by processing with a color developer at 30° C. for 3 min 15 sec is taken as the saturated film thickness and a time necessitated for attaining ½ of this thickness is taken as $T_{\frac{1}{2}}$.

The swelling rate of the film $T_{\frac{1}{2}}$ can be controlled by adding a hardener to a gelatin used as the binder or by varying the time period condition after the application. The swelling rate is desirably 150 to 400%. The swelling rate can be calculated from the maximum swollen film thickness determined under the above-described conditions according to the following formula:

(maximum thickness of swollen film)−(film thickness)/(film thickness)

The above-described photosensitive material for color photography can be developed by an ordinary method described in the above-mentioned RD No. 17643, pages 28 to 29, and RD No. 18716, page 615, left and right columns.

The color developer used for the development of the photosensitive material is preferably an aqueous alkaline solution of an aromatic primary amine color developing agent as the main ingredient. As the color developing agents, aminophenol compounds are useful and particularly p-phenylenediamine compounds are preferably used. Typical examples of them include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, as well as sulfates, hydrochlorides and p-toluenesulfonates of them. These compounds are usable either singly or in combination of them.

The color developer usually contains a pH buffering agent such as an alkali metal carbonate, borate or phosphate; a development inhibitor such as a bromide, iodide, benzimidazole, benzothiazole or mercapto compound; or an antifoggant. The color developer may contain, if necessary, preservatives such as hydroxylamine, diethylhydroxylamine, hydrazine sulfites, phenylsemicarbazides, triethanolamine, catechol sulfonic acids and triethylenediamines (1,4-diazabicyclo[2,2,2]octane); organic solvents such as ethylene glycol and diethylene glycol; development accelerators such as benzyl alcohol, polyethylene glycols, quaternary ammonium salts and amines; dye-forming couplers; competing couplers; fogging agents such as sodium boron hydride; assistant developing agents such as 1-phenyl-3-pyrazolidone; thickening agents; chelating agents typified by aminopolycarboxylic acids, aminopolyphosphonic acids, alkylphosphonic acids and phosphonocarboxylic acids [such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of them]; fluorescent brightening agents such as 4,4'-diamino-2,2'-disulfostilbene compounds; and surfactants such as alkylsulfonic acids, arylsulfonic acids, aliphatic carboxylic acids and aromatic carboxylic acids.

However, the color developer preferably contains substantially no benzyl alcohol from the viewpoints of environmental pollution, solution preparability and prevention of stain. The term "substantially" herein indicates that benzyl alcohol content is 2 ml/l or below (preferably the color developer is completely free from benzyl alcohol).

In case a reversal process is conducted, the color development is conducted usually after black-and-white development. Black-and-white developers usable herein comprise a well-known black-and-white developing agent, for example, a dihydroxybenzene such as hydroquinone; a 3-pyrazolidone such as 1-phenyl-3-pyrazolidone or an aminophenol such as N-methyl-p-aminophenol. They can be used either singly or in combination of them.

The pH of these color developers and black-and-white developers is usually 9 to 12. The amount of the developer to be replenished is usually 3 l or below per $m^2$ of the photosensitive material for color photography, though it varies depending on the photosensitive material. It can be reduced to 500 ml or below by reducing bromide ion concentration in the replenisher. A photosensitive material of a high-silver chloride content is particularly preferably used, since bromine ion content of the color developer is reduced and chloride ion is made relatively high to realize excellent photographic properties and processability, while variation in the photographic properties is controlled when it is used. In such a case, the amount of the replenisher can be reduced to about 20 ml per $m^2$ of the photosensitive material. With such an amount of the replenisher, substantially no overflow of the color developing bath is caused. When the amount of the replenisher is reduced, it is desirable to prevent evaporation of the solution and oxidation thereof with air by reducing the contact area between the processing bath and air. It is also possible to reduce the amount of the replenisher by inhibiting the deposition of bromide ion in the developer.

The processing temperature with the color developer of the present invention is 20° to 50° C., preferably 30° to 45° C. The processing time ranges from 20 sec to 5 min, preferably from 30 sec to 3 min. The processing time can be further reduced by using the color developing agent of a high concentration at a high temperature and at a high pH.

After completion of the color development, the photographic emulsion layer is usually bleached. The bleaching and fixing can be conducted at the same time (bleach-fixing process) or separately from each other. For rapidly conducting the process, the bleaching can be followed by bleach-fixing. In addition, two connected bleach-fixing baths can be used for the process;

the fixing can be conducted prior to the bleach-fixing; or the bleach-fixing can be followed by the bleaching depending on the purpose. Bleaching agents usable herein include, for example, compounds of polyvalent metals such as iron (III), cobalt (III), chromium (Iv) and copper (II), peracids, quinones and nitro compounds. Typical bleaching agents include ferricyanides; dichromates; organic complex salts of iron (III) or cobalt (III) such as complex salts of such a metal with aminopolycarboxylic acids, e.g. ethylenediaminetetraacetic acid, diethylenetriaminepentaacetic acid, cyclohexanediaminetetraacetic acid, methyliminodiacetic acid, 1,3-diaminopropanetetraacetic acid as well as glycol ether diaminetetraacetic acid, citric acid, tartaric acid and malic acid; persulfates; hydrobromates; permanganates; and nitrobenzenes. Among them, iron (III) complex salts of aminopolycarboxylic acids such as iron (III) complex salt of ethylenediaminetetraacetic acid and the persulfates are preferred from the viewpoints of the rapid process and prevention of environmental pollution. The iron (III) complex salts of aminopolycarboxylic acids are particularly useful in both the bleaching solution and bleach-fixing solution. Iron (III) complex salt of 1,3-diaminopropanetetraacetic acid is particularly preferred in virtue of its bleaching power for a bleaching solution for a negative photosensitive material for photography. The pH of the bleaching solution or bleach-fixing solution containing such an iron (III) complex salt of aminopolycarboxylic acid is usually 5.5 to 8. For accelerating the process, the process can be conducted at a lower pH.

A bleaching accelerator can be incorporated into the bleaching solution, bleach-fixing solution and pre-processing baths, if necessary. Examples of useful bleach-accelerators are those described in the following specifications: compounds having a mercapto group or disulfido group described in, for example, U.S. Pat. No. 3,893,858, West German Patent Nos. 1,290,812 and 2,059,988, Japanese Patent KOKAI Nos. Sho 53-32736, 53-57831, 53-37418, 53-72623, 53-95630, 53-95631, 53-104232, 53-124424, 53-141623 and 53-28426 and RD No. 17129 (July, 1978); thiazolidine derivatives described in J.P. KOKAI No. Sho 50-140129; thiourea derivatives described in J.P. KOKOKU No. Sho 45-8506 and J.P. KOKAI Nos. Sho 52-20832 and 53-32735 and U.S. Pat. No. 3,706,561; iodide salts described in West German Patent No. 1,127,715 and J.P. KOKAI No. Sho 58-16,235; polyoxyethylene compounds described in west German Patent Nos. 966,410 and 2,748,430 polyamine compounds described in J.P. KOKOKU No. Sho 45-8836; compounds described in J.P. KOKAI Nos. Sho 49-42434, 49-59644, 53-94927, 54-35727, 55-26506 and 58-163940; and bromide ion. Among these, the compounds having a mercapto group or disulfido group are preferred, since their accelerating effect is remarkable and particularly compounds described in U.S. Pat. No. 3,893,858, West German patent No. 1,290,812 and J.P. KOKAI No. Sho 53-95630 are preferred. Further compounds described in U.S. Pat. No. 4,552,834 are also preferred. These bleaching accelerators can be incorporated into the photosensitive material. These bleaching accelerators are effective particularly when the color photosensitive material for photographing is to be bleach-fixed.

The bleach-fixing solution of the present invention can contain known additives such as rehalogenating agents, e.g. ammonium bromide and ammonium chloride, pH buffering agents, e.g. ammonium nitrate and corrosion inhibitors for metals, e.g. ammonium sulfate.

The fixing bath of the present invention can contain a known fixing agent in addition to the compound of the present invention. The fixing agents include, for example, thiosulfates, thiocyanates, thioether compounds, thioureas and a large amount of iodide salts. The thiosulfates are usually used. Particularly ammonium thiosulfate is preferred from the viewpoints of solubility and fixing speed and is usable in combination with another fixing agent. Preservatives for the bleach-fixing solution are preferably suifites, hydrogensulfites, carbonylhydrogensulfuric acid adducts and sulfinic acid compounds. The fixing solution preferably contains an aminopolycarboxylic acid or organophosphonic acid chelating agent (desirably 1-hydroxyethylidene-1,1-diphosphonic acid or N,N,N',N'-ethylenediaminetetraphosphonic acid) so as to improve the stability of the fixing solution.

The fixing solution can further contain a fluorescent brightener, antifoaming agent, surfactant, polyvinylpyrrolidone and methanol.

The fixing for color photosensitive materials is preferably conducted at a temperature of 20° to 50° C. for 20 sec to 5 min, more preferably 30° to 45° C. for 30 sec to 4 min. The bleach-fixing for color photosensitive materials is preferably conducted at a temperature of 20° to 50° C. for 20 sec to 5 min, preferably 30° to 45° C. for 30 sec to 3 min.

To reduce the desilverization process time, it is desirable to stir the processing solutions as strongly as possible. The stirring means are those described in, for example, J.P. KOKAI Nos. Sho 62-183460 and 62-183461. When a jet is to be bumped, the bumping is conducted preferably within 15 sec after the photosensitive material has been introduced into the processing solution.

The crossover time from the color developer to the bleaching solution (a time after leaving the color developer and before immersion in the bleaching solution) for the photosensitive material is preferably within 10 sec from the viewpoints of the bleach fogging and staining of the surface of the photosensitive material. The crossover time from the bleaching solution to the processing solution having the fixing function is preferably within 10 sec so as to improve the color restoration of the cyan dye.

When the color photosensitive material for photographing (amount of applied silver: for example, 4 to 12 $g/m^2$) is used, the amount of the fixing solution to be replenished is preferably 800 $ml/m^2$ or below, more preferably 500 $ml/m^2$ or below, the most preferably 300 $ml/m^2$ or below and the amount of the bleach-fixing solution to be replenished is preferably 500 $ml/m^2$ or below, more preferably 40 to 350 $ml/m^2$, most preferably 60 to 300 $ml/m^2$.

The silver halide color photosensitive material used in the present invention is usually washed with water and/or stabilized after the desilverization process. The quantity of water used in the washing step can be selected in a wide range depending on the properties and use of the photosensitive material (such as starting materials, e.g. coupler), temperature of water used for washing, number of tanks for washing with water (number of stages), replenishing method (counter-flow or down-flow method) and various other conditions.

Although the amount of water necessitated for washing can be remarkably reduced by the multi-stage counter-flow system described in the above-described literatures, another problem is posed in this method that bacteria propagate themselves while the photosensitive material is kept for a longer time in the tanks and, as a result, a suspended matter thus formed is fixed on the sensitive material. For solving this problem in the processing of the color photosensitive material of the present invention, a quite effective method for reducing in amount of Ca ion and Mg ion described in J.P. KOKAI No. Sho 62-288838 can be employed. Further, this problem can be solved also by using isothiazolone compounds described in J.P. KOKAI No. Sho 57-8542, thiabendazoles, chlorine-containing germicides such as chlorinated sodium isocyanurates, benzotriazoles and germicides described in Hiroshi Horiguchi "Bokin Bobai-zai no Kagaku", "Biseibutsu no Mekkin, Sakkin, Bobai Gijutsu" edited by Eisei Gijutsu-kai and "Bokinbobai-zai Jiten" edited by Nippon Bokinbobai Gakkai.

The pH of water used for washing the photosensitive material of the present invention is 4 to 9, preferably 5 to 8. The temperature of water to be used for washing and the washing time which vary depending on the properties and use of the photosensitive material are usually 15° to 45° C. and 20 sec to 10 min, respectively, and preferably 25° to 40° C. and 30 sec to 5 min, respectively. The photosensitive material of the present invention can be processed directly with a stabilizing solution in place of washing with water. The stabilization can be conducted by any of known processes described in J.P. KOKAI Nos. Sho 57-8543, 58-14834 and 60-220345.

The washing with water may be followed by a stabilization process. In the stabilization, a stabilizing bath containing a dye stabilizer typified by formalin, hexamethylenetetramine, hexahydrotriazine or an N-methylol compound is usable. This stabilizing bath is usually used as the final bath for the photosensitive material for color photography. The stabilizing bath can contain, if necessary, an ammonium compound, a compound of a metal such as Bi or Al, a fluorescent brightener, a chelating agent, a film pH adjustor, a hardener, a germicide, an antifungal agent, an alkanolamine and a surfactant (preferably silicon surfactant). Water used in the step of washing with water or in the stabilizing step is preferably city water, water deionized to a Ca ion or Mg ion concentration of 5 mg/l or below with an ion exchange resin or the like, or water sterilized with a halogen or ultraviolet sterilization lamp.

The amount of the washing water and/or stabilizing solution to be replenished is 1 to 50 times, preferably 2 to 30 times and still preferably 2 to 15 times, as much as the water brought from the preprocessing bath per a unit area of the photosensitive material. An overflow formed by the replenishment is reusable in another step such as the desilverization step.

The color photosensitive silver halide material used in the present invention may contain a color developing agent for the purpose of simplifying and accelerating the process. The color developing agents are preferably used in the form of precursors thereof. Examples of them include indoaniline compounds described in U.S. Pat. No. 3,342,597, Schiff base compounds described in U.S. Pat. No. 3,342,599, RD Nos. 14,850 and 15,159; aldol compounds described in RD No. 13,924; metal salt complexes described in U.S. Pat. No. 3,719,492; and urethane compounds described in J.P. KOKAI No. Sho 53-135628.

The silver halide color photosensitive material of the present invention may contain a 1-phenyl-3-pyrazolidone compound, if necessary, for the purpose of accelerating the color development. Typical examples of the compounds are described in, for example, J.P. KOKAI Nos. Sho 56-64339, 57-144547 and 58-115438.

The temperature of the processing solutions used in the present invention are controlled at 10° to 50° C. The standard temperature is 33° to 38° C., but a higher temperature can be employed to accelerate the process and thereby to reduce the process time or, on the contrary, a lower temperature can also be employed to improve the quality of the image and stability of the processing liquid.

An example of the silver halide color photosensitive materials contains a silver halide of direct positive type. The description will be made on the process for such a photosensitive material.

After the image-exposure, the silver halide color photosensitive material is preferably color-developed and bleach-fixed with a surface developer containing an aromatic primary amine color developing agent and having a pH of not higher than 11.5 after or in the course of fogging with light or a nucleating agent to directly form the positive color image. The pH of the developer is desirably in the range of 11.0 to 10.0.

In the present invention, the fogging can be conducted by either a so-called optical fogging method wherein the whole surface of the photosensitive layer is subjected to the second exposure or chemical fogging method wherein the development is conducted in the presence of a nucleating agent. The development can be conducted in the presence of the nucleating agent and fogging light. The photosensitive material can be fogging-exposed with the nucleating agent contained therein.

The optical fogging method is described in the specification of the above-mentioned Japanese Patent Application No. Sho 61-253716 (from line 4, page 47, to line 5, page 49). The nucleating agents usable in the present invention are mentioned also in that specification (from line 6, page 49 to line 2, page 67), and compounds of general formulae [N-1] and [N-2] are particularly preferably used. Preferred examples of them include [N-I-1] to [N-I-10] mentioned on pages 56 to 58 and [N-II-1] to [N-II-12] mentioned on pages 63 to 66 of that specification.

Nucleation accelerators usable in the present invention are mentioned in that specification (from line 11, page 68 to line 3, page 71) and preferred examples of them include (A-1) to (A-13) mentioned on pages 69 to 70.

The detailed description will be made on the silver halide black-and-white photosensitive material and process for using it. The halogen composition of the silver halide emulsion used is not particularly limited. Any of silver chloride, silver chlorobromide, silver bromoiodide, silver bromide and silver chlorobromoiodide is usable. The amount of silver iodide contained therein is preferably 10 molar % or below, particularly 5 molar % or below.

When the silver halide is used for forming a negative image of a high contract, the average grain size of the silver halide is preferably as small as, for example, 0.7 μm or below, particularly 0.5 μm or below. Although the grain size distribution is basically not limited, a monodispersed one is preferred. The term "monodispersed silver halide emulsion" herein indicates that at least 95% of the grains (in terms of either weight or number) have a size of the average grain size ±40%. The silver halide grains in the photographic emulsion may be in a regular crystal form such as cubic, octahedral, rhombo-dodecahedral or tetradecahedral form; or in an irregular crystal form such as spherical or tabular form; or a complex crystal form thereof.

As for the other aspects of the photographic emulsion, fundamentally refer to the above description on the photographic emulsion.

To increase the maximun density (Dmax), it is desirable that the silver halide emulsion layer of the present invention contains two kinds of monodisperse emulsions having different average grain sizes as disclosed in Japanese Patent Application Nos. Sho 60-64199 and 60-232086. The small-size monodisperse grains are desirably chemically sensitized. The most desirable chemical sensitization method is sulfur sensitization method. The large-size monodisperse grains may be either chemically sensitized or not. The large-size monodisperse grains are usually not chemically sensitized, since black pepper is easily formed by the sensitization. However, when the chemical sensitization is conducted, it is particularly desirable to conduct it only slightly so that no black pepper will be formed. The term "only slightly" herein indicates that the chemical sensitization time is made shorter than that in the chemical sensitization of the small-size grains or the temperature is made lower than that in the latter or the amount of the chemical sensitizer is reduced. Although the difference in the sensitivity between the large-size monodisperse emulsion and the small-size monodisperse emulsion is not particularly limited, $\Delta\log E$ is 0.1 to 1.0, preferably 0.2 to 0.7. Preferably the sensitivity of the large-size monodisperse emulsion is higher. The average grain size of the small-size monodisperse emulsion is not larger than 90%, preferably not larger than 80%, of the average grain size of the large-size monodisperse emulsion.

A well-known nucleating agent can be incorporated into a photographic emulsion layer or another hydrophilic colloid layer of the printing photosensitive material to be processed by the present invention so as to form a super high contrast image. The nucleating agents usable in the present invention are, for example, those described in Research Disclosure, Item 23516 (November, 1983, p. 346) and also in literatures cited therein.

The accelerators for the development and nucleating infectious development usable in the present invention include compounds disclosed in J.P. KOKAI Nos. Sho 53-77616, 54-37732, 53-137133, 60-140340 and 60-14959 as well as compounds containing N or S atom.

A desensitizer can be incorporated into a photographic emulsion layer or another hydrophilic colloid layer of the direct positive photosensitive material used in the present invention. Organic desensitizers are determined by half wave potential in its polarograph, namely, by oxidation-reduction potential determined by polarography. The sum of the polaro-anode potential and cathode potential must be positive.

As the organic desensitizers, those of general formulae (III) to (V) given on pages 55 to 72 of Japanese Patent Application No. Sho 61-280998 are preferably used.

The developer used for the development of the silver halide black-and-white photosensitive material of the present invention can contain ordinary additives (such as developing agent, alkali, pH buffering agent, preservative and chelating agent). The process of the present invention can be conducted by any of known methods with any of known processing solutions. Although the processing temperature is usually selected in the range of 18° to 50° C., a temperature below 18° C. or above 50° C. can be also employed.

The black-and-white developer can comprise a known developing agent. The developing agents include, for example, dihydroxybenzenes (such as hydroquinone), 1-phenyl-3-pyrazolidones and aminophenols (such as N-methyl-p-aminophenol). These developing agents are usable either singly or in combination of them.

The dihydroxybenzene developing agent is usually used in an amount of preferably 0.05 to 0.8 mol/l. When a combination of the dihydroxybenzene compound with the 1-phenyl-3-pyrazolidone compound or p-aminophenol compound is used, it is desirable to use the former in an amount of 0.05 to 0.5 mol/l and the latter in an amount of 0.06 mol/l or below.

The sulfite preservatives usable in the present invention include, for example, sodium sulfite, potassium sulfite, lithium sulfite, sodium hydrogensulfite, potassium metabisulfite and formaldehyde sodium hydrogensulfite.

At least 0.3 mol/l of a sulfite is contained in black-and-white developers, particularly developers for graphic arts. However, the upper limit of the amount of the sulfite is preferably 1.2 mol/l, since when an excess amount of the sulfite is used, it is precipitated in the developer to contaminate the solution.

The alkalis contained in the developer of the present invention include pH adjustors and buffering agents such as sodium hydroxide, potassium hydroxide, sodium carbonate, potassium carbonate, trisodium phosphate, tripotassium phosphate, sodium silicate and potassium silicate.

Additives other than those described above and usable in the present invention include devlopment inhibitors such as boric acid, borax, sodium bromide, potassium bromide and potassium iodide; organic solvents such as ethylene glycol, diethylene glycol, triethylene glycol, dimethylformamide, methyl cellosolve, hexylene glycol, ethanol and methanol; antifoggants or black pepper formation inhibitors such as mercapto compounds, e.g. 1-phenyl-5-mercaptotetrazole and sodium 2-mercaptobenzimidazole-5-sulfonate, indazole compounds, e.g. 5-nitroindazole, and benzotriazole compounds, e.g. 5-methylbenzotriazole. If necessary, a color tone controller, surfactant, antifoaming agent, softening agent for hard water and hardener are also usable. As silver stain inhibitors, compounds mentioned in J.P. KOKAI No. 56-24347 are usable. As uneven-development inhibitors, compounds mentioned in J.P. KOKAI No Sho 62-212651 are usable and as solubilizers, compounds mentioned in Japanese Patent Application No. Sho 60-109743 are usable.

The developer used in the present invention contains a buffering gent selected from among boric acid mentioned in Japanese Patent Application No. 61-28708, saccharides (such as saccharose), oximes (such as acetoxime), phenols (such as 5-sulfosalicylic acid) and tertiary phosphoric acid salts (such as sodium and potassium salts) mentioned in J.P. KOKAI No. 60-93433.

The fixing solution is an aqueous solution of a fixing agent, which contains, if necessary, a hardener (such as a water-soluble alulminum compound), acetic acid and a dibasic acid (such as tartaric acid, citric acid or a salt thereof). The pH of the fixing solution is preferably at least 3.8, still preferably 4.0 to 7.5. The fixing bath of the present invention can contain a known fixing agent in addition to the compound of the present invention. The fixing agent is particularly preferably sodium thiosulfate or ammonium thiosulfate. From the viewpoint of the fixing velocity, ammonium thiosulfate is particularly preferred. The amount of the fixing agent used can be suitably varied and is usually about 0.1 to 0.5 mol/l. The water-soluble aluminum salts usable mainly as the hardener in the fixing solution are compounds generally known as hardeners contained in acidic hardening fixing solutions. They include, for example, aluminum chloride, alluminum sulfate and potash alum. The dibasic acids include tartaric acid and derivatives thereof and citric acid and derivatives thereof. They are usable either singly or in combination of two or more of them. These compounds are effective when they are contained in an amount of at least 0.005 mol/l, particularly 0.01 to 0.03 mol per liter of the fixing solution. Examples of them include tartaric acid, potassium tartrate, sodium tartrate, potassium sodium tartrate, ammonium tartrate and potassium ammonium tartrate.

The fixing solution further contains, if necessary, preservatives (such as sulfites and hydrogensulfites), pH buffering agents (such as acetic acid and boric acid), pH adjustors (such as ammonia and sulfuric acid), image-preserving agents (such as potassium iodide) and chelating agents. The pH adjustor is used in an amount of about 10 to 40 g/l, preferably about 18 to 25 g/l, since pH of the developer is high.

The fixing temperature and time are the same as the development temperature and time. The fixing is preferably conducted at about 20° to 50° C. for 10 sec to 1 min. The amount of the fixing agent to be replenished is desirably not larger than 300 ml/m$^2$.

Water used for washing can be the same as that described above, or a stabilizing solution can be used in place of the water.

Since automatic developing machines of roller conveyer type are described in, for example, U.S. Pat. Nos. 3,025,779 and 3,545,971, they are only referred to herein as processors of roller conveyer type. The process conducted with the processers of roller conveyer type comprises four steps of the development, fixing, washing with water and drying. It is most desirable that the process of the present invention comprises these four steps and, if necessary, other steps (such as termination step). In the step of washing with water, the water can be saved by employing a countercurrent washing method comprising 2 or 3 stages.

The following Examples will further illustrate the present invention, which by no means limit the invention.

Example 1

A multi-layered color printing paper having the following layer construction formed on a paper support the both surfaces of which had been laminated with polyethylene was prepared. The coating solutions were prepared as follows:

Preparation of coating solution for forming the first layer:

27.2 ml of ethyl acetate and 8.2 g of a solvent (Solv-1) were added to a mixture of 19.1 g of yellow coupler (ExY), 4.4 g of a color image stabilizer (cpd-1) and 0.7 g of another color image stabilizer (Cpd-7) to prepare a solution, which was emulsion-dispersed in 185 ml of 10% aqueous gelatin solution containing 8 ml of 10% sodium dodecylbenzenesulfonate. On the other hand, $2.0\times10^{-4}$ mol (large size emulsion) or $2.5\times10^{-4}$ mol (small size emulsion), per mol of silver, of a blue-sensitive sensitizing dye which will be described below was added to a silver chlorobromide emulsion [mixture of cubic grains having an average grain size of 0.88 μm and those of 0.70 μm in a molar ratio of 3:7; coefficient of variation of grain size distribution 0.08 and 0.10, respectively; and each containing 0.2 molar % of silver halide in the grain surface layer). They were sensitized with sulfur. This emulsion was mixed with the emulsion dispersion prepared as described above to form a solution. The first coating solution having a composition which will be given below was prepared.

Coating solutions for forming the second layer through the seventh layer were prepared in the same manner as that for forming the first coating solution. Sodium salt of 1-hydroxy-3,5-dichloro-s-triazine was used as the gelatin hardener in each layer.

The following spectral sensitizing dyes were used in the respective layers:

tive emulsion layer:

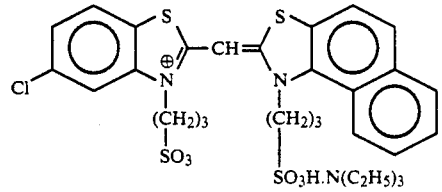

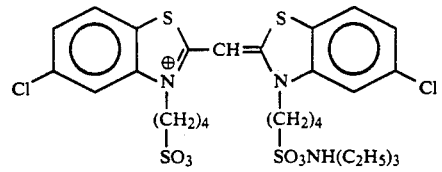

($2.0\times10^{-4}$ mol, per mol of the silver halide, for the large-size grain emulsion and $2.5\times10^{-4}$ mol for the small-size grain emulsion)

Green-sensitive emulsion layer:

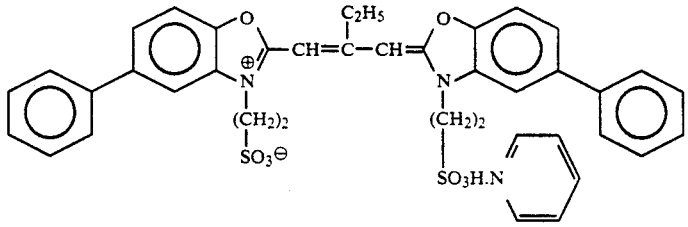

($4.0\times10^{-4}$ mol, per mol of the silver halide, for the large-size grain emulsion and $5.6\times10^{-4}$ mol for the small-size grain emulsion) and

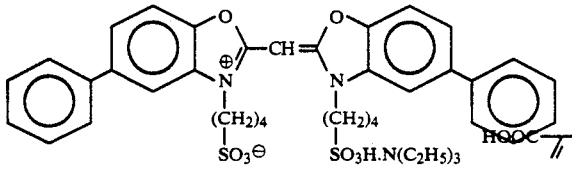

($7.0\times10^{-5}$ mol, per mol of the silver halide, for the large-size grain emulsion and $1.0\times10^{-5}$ mol for the small-size grain emulsion)

Red-sensitive emulsion layer:

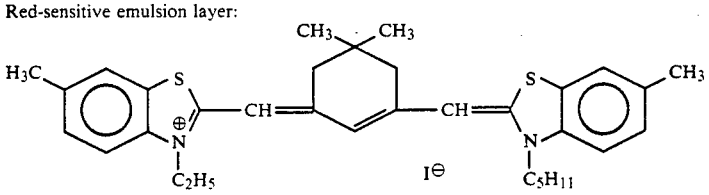

($0.9\times10^{-4}$ mol, per mol of the silver halide, for the large-size grain emulsion and $1.1\times10^{-4}$ mol for the small-size grain emulsion)

$2.6\times10^{-4}$ mol, per mol of the silver halide, of the following compound was incorporated into the red-sensitive emulsion layer:

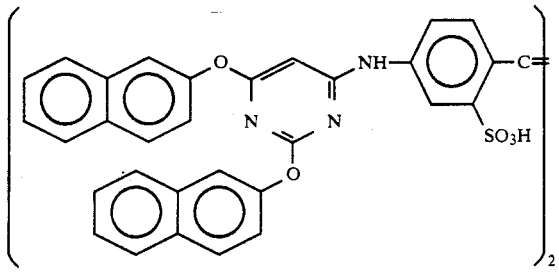

$8.5\times10^{-5}$ mol, $7.7\times10^{-4}$ mol and $2.5\times10^{-4}$ mol, per mol of the silver halide, of 1-(5-methylureidophenyl)-5-mercaptotetrazole was incorporated into the blue-sensitive emulsion layer, green-sensitive emulsion layer and red-sensitive emulsion layer, respectively.

$1\times10^{-4}$ mol and $2\times10^{-4}$ mol, per mol of the silver halide, of 4-hydroxy-6-methyl-1,3,3a,7-tetrazaindene was incorporated into the blue-sensitive emulsion layer and green-sensitive emulsion layer, respectively.

The following dyes were incorporated into the emulsion layers in order to prevent irradiation:

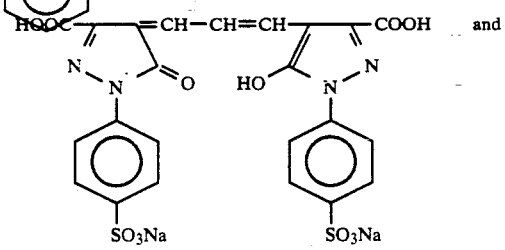

and

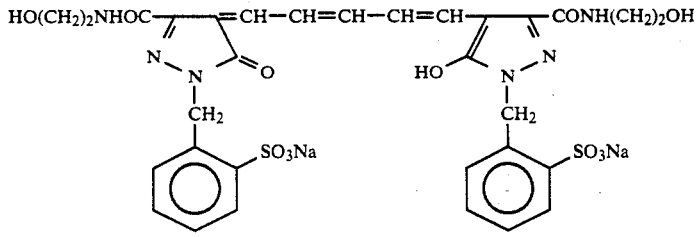

Layer construction

The compositions of the respective layers will be shown below. The numerals represent the amounts ($g/m^2$) of the components used for forming the layers. The amount of the silver halide emulsion is given in terms of silver used for forming the layer.

Support

Polyethylene-laminated paper

[containing a white dye ($TiO_2$) and a blue dye (ultramarine) in the polyethylene layer on the first layer side]

| | |
|---|---|
| The first layer (blue-sensitive layer): | |
| Above-described silver bromide emulsion | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Color image stabilizer (Cpd-7) | 0.06 |
| The second layer (color mixing-inhibition layer) | |
| Gelatin | 0.99 |
| Color mixing inhibitor (Cpd-5) | 0.08 |
| Solvent (Solv-1) | 0.16 |
| Solvent (Solv-4) | 0.08 |
| The third layer (green-sensitive layer) | |
| Silver chlorobromide emulsion [mixture of cubic grains having average grain size of 0.55 μm and | 0.12 |

-continued

| | |
|---|---|
| those of 0.39 μm in a molar ratio of 1:3 (in terms of Ag); Coefficient of variation of grain size distribution being 0.10 and 0.08; 0.8 molar % of AgBr being contained in the surface layer of the grains in each emulsion] | |
| Gelatin | 1.24 |
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |
| The fourth layer (ultraviolet ray-absorbing layer) | |
| Gelatin | 1.58 |
| Ultraviolet ray-absoring agent (UV-1) | 0.47 |
| Color mixing-inhibiting agent (Cpd-5) | 0.05 |
| Solvent (Solv-5) | 0.24 |
| The fifth layer (red-sensitive layer) | |
| Silver chlorobromide emulsion [mixture of cubic grains having average grain size of 0.58 μm and those of 0.45 μm in a molar ratio of 1:4 (in terms of Ag); Coefficient of variation of grain size distribution being 0.09 and 0.11; 0.6 molar % of AgBr being contained in a part of the surface layer of the grains in each emulsion] | 0.23 |
| Gelatin | 1.34 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| The sixth layer (ultraviolet ray-absoring layer) | |
| Gelatin | 0.53 |
| Ultraviolet ray-absoring agent (UV-1) | 0.16 |
| Color mixing-inhibitor (Cpd-5) | 0.02 |
| Solvent (Solv-5) | 0.08 |
| The seventh layer (protecting layer) | |
| Gelatin | 1.33 |
| Acryl-modified copolymer of polyvinyl alcohol (degree of modification; 17%) | 0.17 |
| Liquid paraffin | 0.03 |

The compounds used as described above were as follows:

(ExY) Yellow coupler

Mixture of compounds of the following formula:

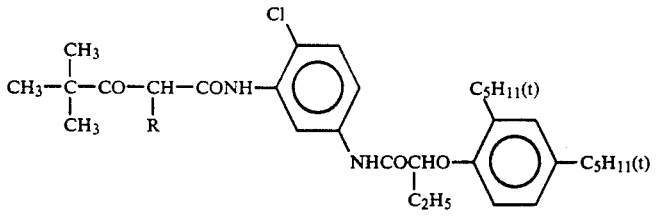

wherein R represents

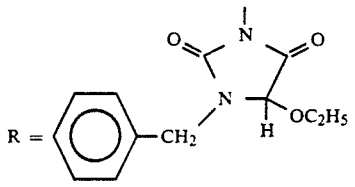

and

-continued

R = 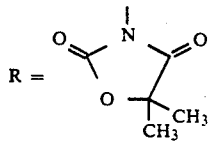

in a molar ratio of 1:1

(ExM) Magenta coupler

Mixture of compounds of the following formulae:

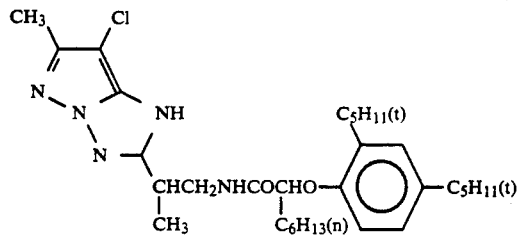

and

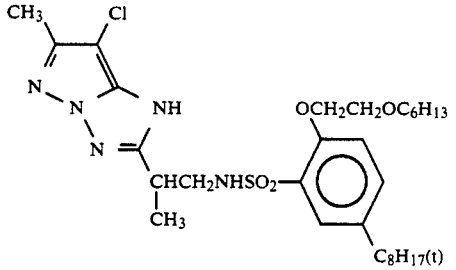

in a molar ratio of 1:1.

(ExC) Cyan coupler

Mixture of compounds of the following formulae:

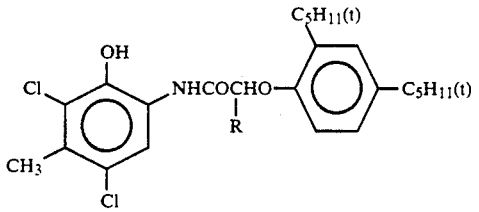

wherein R is $C_2H_5$ and $C_4H_9$ and

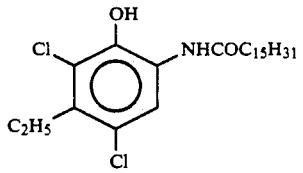
in a weight ratio of 2:4:4.
(Cpd-1) Color image stabilizer:
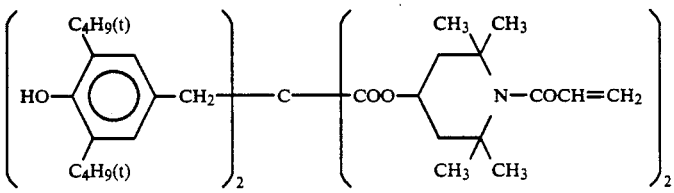
(Cpd-2) Color image stabilizer:
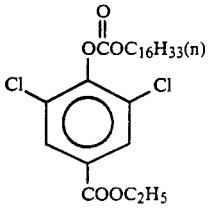
(Cpd-3) Color image stabilizer:
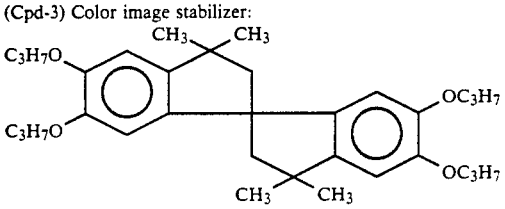
(Cpd-4) Color image stabilizer:
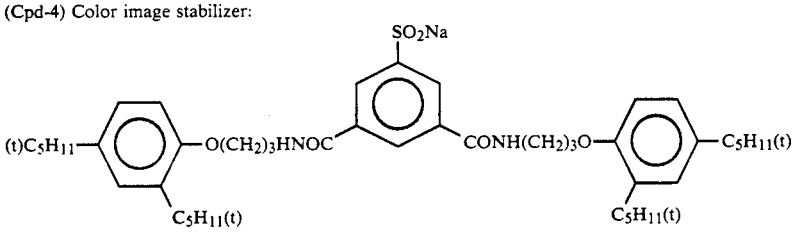
(Cpd-5) Color-mixing inhibitor:
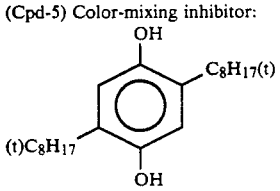
(Cpd-6) Color image stabilizer
Mixture of compounds of the following formulae:
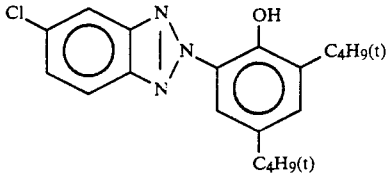
-continued
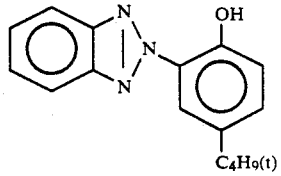
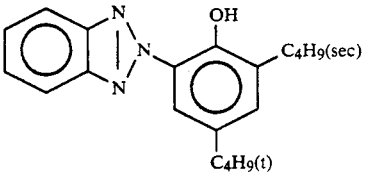
in a weight ratio of 2:4:4.
(Cpd-7) Color image stabilizer:

-continued

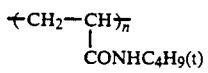

average moleclar weight: 60,000

(Cpd-8) Color image stabilizer:

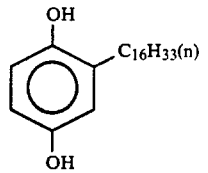

(Cpd-9) Color image stabilizer:

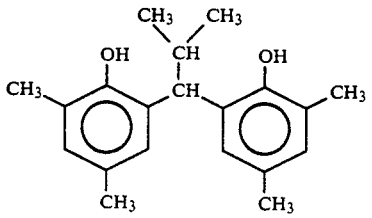

(UV-1) Ultraviolet absorber

Mixture of compounds of the following formulae:

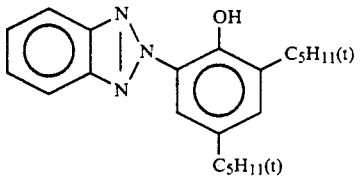

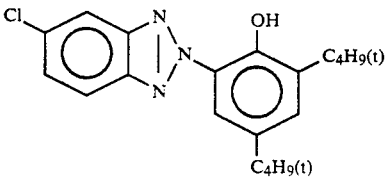

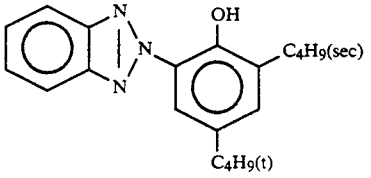

in a weight ratio of 4:2:4.

(Solv-5) Solvent:

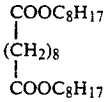

(Solv-6) Solvent:

-continued

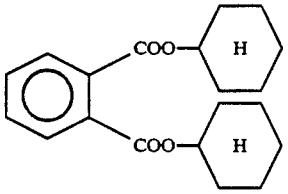

The sample prepared as described above was cut into pieces, which were subjected to an exposure to light and then to a running test with a paper-processing machine until a bleach-fixing solution had been replenished in an amount of twice as much as the tank capacity.

| Step | Temp. (°C.) | Time (sec) | Amount of replenisher* (ml) | Tank capacity (l) |
|---|---|---|---|---|
| Color development | 39 | 45 | 70 | 20 |
| Bleach-fixing | 35 | 25 | (1) 60** or (2) 40** | 20 |
| Rinse (1) | 35 | 20 | — | 10 |
| Rinse (2) | 35 | 20 | — | 10 |
| Rinse (3) | 35 | 20 | 360 | 10 |
| Drying | 80 | 60 | | |

[3-tank countercurrent method from rinse (3) to rinse (1)]

*Amount of the replenisher per $m^2$ of the photosensitive material

**In addition to 60 ml or 40 ml of the replenisher, 120 ml thereof from rinse (1) was added per $m^2$ of the photosensitive material.

| Color developer | Mother liquor | Replenisher |
|---|---|---|
| Water | 700 ml | 700 ml |
| Diethylenetriaminepentaacetic acid | 0.4 g | 0.4 g |
| N,N,N-Trimethylenephosphonic acid | 4.0 g | 4.0 g |
| 1-Hydroxyethylidene-1,1-diphosphonic acid | 0.4 g | 0.4 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightener (WHITEX 4B; a product of Sumitomo Chemical Co., Ltd.) | 1.0 g | 3.0 g |
| Sodium sulfite | 0.1 g | 0.1 g |
| N,N-Bis(sulfoethyl)hydroxylamine | 10.0 g | 13.0 g |
| N-Ethyl-N-(β-methanesulfonamidoethyl)-3-methyl-4-aminoaniline sulfate | 5.0 g | 11.5 g |
| Water | ad 1000 ml | ad 1000 ml |
| pH (25 ° C.) | 10.10 | 11.10 |

| Bleach-fixing solution | Mother liquor | Replenisher (1) | Replenisher (2) |
|---|---|---|---|
| Water | 500 ml | 100 ml | 100 ml |
| Fixing agent (see Table 1) | 0.5 mol | 1.25 mol | 1.25 mol |
| Ammonium sulfite (used only when the fixing agent was ammonium thiosulfate) | 40 g | 100 g | 100 g |
| Ferric ammonium ethylenediamine-tetraacetate dihydrate (bleaching agent) | 0.15 mol | 0.37 mol | 0.37 mol |
| Chelating agent (the same as that used for bleaching agent) | 0.02 mol | 0.04 mol | 0.04 mol |
| Ammonium bromide | 40 g | 75 g | 150 g |
| Nitric acid (67%) | 30 g | 65 g | 100 g |
| Water ad | 1000 ml | 1000 ml | 1000 ml |
| pH (25° C.) (adjusted with acetic acid or ammonia) | 5.8 | 5.6 | 5.4 |

Rinsing water (both mother liquor and replenisher)

Ion-exchanged water (containing 3 ppm or below of calcium and magnesium)

Evaluation of desilverization function

Before completion of the running process, the amount of silver remaining in the unexposed part of the black-and-white exposed film was determined with a fluorescent X-ray analyzer.

Evaluation of stability of solution

The presence of precipitates in the bleach-fixing bath and rinse (1) bath was macroscopically examined after the running process.

The criteria were as follows:

○: No precipitation was macroscopically found.

Δ: A small amount of precipitation was found.

×: A large amount of precipitation was found.

The results are given in Table 1.

TABLE 1

| Fixing agent | Replenished bleach-fixing bath | Amount of remaining silver (μg/cm²) | Presence of precipitate in bleach-fixing bath | Presence of precipitate in rinse (1) bath | Remarks |
|---|---|---|---|---|---|
| Ammonium | (1) | 10.2 | Δ | Δ | Comp. |
| thiosulfate | (2) | 17.3 | x | x | Ex. |
| Compound-1 | (1) | 1.2 | ○ | ○ | Present |
| | (2) | 1.3 | ○ | ○ | invention |
| Compound-2 | (1) | 0.8 | ○ | ○ | Present |
| | (2) | 0.9 | ○ | ○ | invention |
| Compound-3 | (1) | 0.6 | ○ | ○ | Present |
| | (2) | 0.8 | ○ | ○ | invention |
| Compound-9 | (1) | 0.7 | ○ | ○ | Present |
| | (2) | 0.8 | ○ | ○ | invention |
| Ammonium | (1) | 0.9 | ○ | ○ | Present |
| thiosulfate + compound-3 | (2) | 1.2 | ○ | ○ | invention |

*When ammonium thiosulfate was used in combination with compound-3, the amount of each of them was reduced to ½.

The compounds 1, 2, 3 and 9 where those wherein M was H.

It is apparent from Table 1 that excellent results were obtained. Namely, when the N-oxide compound was used, no precipitation occurred even in the running process, the stability of the solution was excellent and the fixing properties were superior to those of the thiosulfate.

These effects were remarkable particularly when the amount of the replenisher was small.

In cases where the compounds 1, 2, 3, and 9 each was replaced by its sodium salt, the same results described above were obtained.

Example 2

The same test as that of Example 1 was conducted except that compound-1 was replaced with compound 4, 5, 7 or 8 to obtain excellent results like those obtained in Example 1. Namely, a high fixing power was obtained and no precipitation occurred in the running process. These effects were remarkable particularly when the amount of the replenisher was small.

Example 3

The same test as that of Example 1 was conducted except that ferric ammonium ethylenediaminetetraacetate dihydrate used as the bleaching agent in the bleach-fixing solution was replaced with an equimolar amount of ferric ammonium 1,3-propylenediaminetetraacetate monohydrate.

The results are given in Table 2.

TABLE 2

| Fixing agent | Replenished bleach-fixing bath | Amount of remaining silver (μg/cm²) | Presence of precipitate in bleach-fixing bath | Presence of precipitate in rinse (1) bath | Remarks |
|---|---|---|---|---|---|
| Ammonium | (1) | 10.0 | Δ to x | x | Comp. |
| thiosulfate | (2) | 16.2 | x | x | Ex. |
| Compound-1 | (1) | 1.0 | ○ | ○ | Present |
| | (2) | 1.2 | ○ | ○ | invention |
| Compound-2 | (1) | 0.7 | ○ | ○ | Present |
| | (2) | 0.8 | ○ | ○ | invention |
| Compound-3 | (1) | 0.5 | ○ | ○ | Present |
| | (2) | 0.6 | ○ | ○ | invention |
| Compound-9 | (1) | 0.6 | ○ | ○ | Present |
| | (2) | 0.8 | ○ | ○ | invention |
| Ammonium | (1) | 0.8 | ○ | ○ | Present |
| thiosulfate + compound-3 | (2) | 1.1 | ○ | ○ | invention |

*When ammonium thiosulfate was used in combination with compound-3, the amount of each of them was reduced to ½.

It is apparent from Table 2 that excellent results were obtained. Namely, when the N-oxide compound was used, no precipitation occurred even in the running process, the stability of the solution was far superior to that of the thiosulfate, and the fixing properties were superior to those of the thiosulfate.

These effects were remarkable particularly when the amount of the replenisher was small.

Example 4

Sample 101 which was a multi-layered color photosensitive material composed of layers of the following compositions formed on a primed cellulose triacetate film support was prepared.

Compositions of photosensitive layers

The amounts of the silver halides and colloidal silver are given in terms of silver applied (g/m$^2$). The amounts of the coupler, additives and gelatin are given in terms of g/m$^2$. The amount of the sensitizing dye is given in terms of molar number thereof per mol of the silver halide contained in the same layer.

| | |
|---|---|
| The first layer (antihalation layer) | |
| Black colloidal silver (in terms of silver) | 0.20 |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| The second layer (intermediate layer) | |
| Fine silver bromoiodide grains (AgI: 1.0 molar %, diameter of corresponding spherical grains: 0.07 μm) (in terms of silver) | 0.15 |
| Gelatin | 1.00 |
| ExC-4 | $6.0 \times 10^{-2}$ |
| Cpd-3 | $2.0 \times 10^{-2}$ |
| The third layer (the first red-sensitive emulsion layer) | |
| Silver bromoiodide emulsion (AgI 5.0 molar %, high surface AgI type, diameter of corresponding spherical grains: 0.9 μm, coefficient of variation of diameter of corresponding spherical grains: 21%, tabular grains, diameter/thickness ratio: 7.5) (in terms of silver) | 0.42 |
| Silver bromoiodide emulsion (AgI 4.0 molar %, high internal AgI type, diameter of corresponding spherical grains: 0.4 μm, coefficient of variation of diameter of corresponding spherical grains: 18%, tetradecahedral grains) (in terms of silver) | 0.40 |
| Gelatin | 1.90 |
| ExS-1 | $4.5 \times 10^{-4}$ mo l |
| ExS-2 | $1.5 \times 10^{-4}$ mo l |
| ExS-3 | $4.0 \times 10^{-5}$ mo l |
| ExC-1 | 0.65 |
| ExC-3 | $1.0 \times 10^{-2}$ |
| ExC-4 | $2.3 \times 10^{-2}$ |
| Solv-1 | 0.32 |
| The fourth layer (the second red-sensitive emulsion layer) | |
| Silver bromoiodide emulsion (AgI 8.5 molar %, high internal AgI type, diameter of corresponding spherical grains: 1.0 μm, coefficient of variation of diameter of corresponding spherical grains: 25%, tabular grains, diameter/thickness ratio: 3.0) (in terms of silver) | 0.85 |
| Gelatin | 0.91 |
| ExS-1 | $3.0 \times 10^{-4}$ mo l |
| ExS-2 | $1.0 \times 10^{-4}$ mo l |
| ExS-3 | $3.0 \times 10^{-5}$ mo l |
| ExC-1 | 0.13 |
| ExC-2 | $6.2 \times 10^{-2}$ |
| ExC-4 | $4.0 \times 10^{-2}$ |
| Solv-1 | 0.10 |
| The fifth layer (the third red-sensitive emulsion layer) | |
| Silver bromoiodide emulsion (AgI 11.3 molar %, high internal AgI type, diameter of corresponding spherical grains: 1.4 μm, coefficient of variation of diameter of corresponding spherical grains: 28%, tabular grains, diameter/thickness ratio· 6.0) (in terms of silver) | 1.50 |
| Gelatin | 1.20 |
| ExS-1 | $2.0 \times 10^{-4}$ mo l |

-continued

| | |
|---|---|
| ExS-2 | $6.0 \times 10^{-5}$ mo l |
| ExS-3 | $2.0 \times 10^{-5}$ mo l |
| ExC-2 | $8.5 \times 10^{-2}$ |
| ExC-5 | $7.3 \times 10^{-2}$ |
| Solv-1 | 0.12 |
| Solv-2 | 0.12 |
| The sixth layer (intermediate layer) | |
| Gelatin | 1.00 |
| Cpd-4 | $8.0 \times 10^{-2}$ |
| Solv-1 | $8.0 \times 10^{-2}$ |
| The seventh layer (the first green-sensitive emulsion layer) | |
| Silver bromoiodide emulsion (AgI 5.0 molar %, high surface AgI type, diameter of corresponding spherical grains: 0.9 μm, coefficient of variation of diameter of corresponding spherical grains: 21%, tabular grains, diameter/thickness ratio: 7.0) (in terms of silver) | 0.28 |
| Silver bromoiodide emulsion (AgI 4.0 molar %, high internal AgI type, diameter of corresponding spherical grains: 0.4 μm, coefficient of variation of diameter of corresponding spherical grains: 18%, tetradecahedral grains) (in terms of silver) | 0.16 |
| Gelatin | 1.20 |
| ExS-4 | $5.0 \times 10^{-4}$ mo l |
| ExS-5 | $2.0 \times 10^{-4}$ mo l |
| ExS-6 | $1.0 \times 10^{-4}$ mo l |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| The eighth layer (the second green-sensitive emulsion layer) | |
| Silver bromoiodide emulsion (AgI 8.5 molar %, high internal AgI type, diameter of corresponding spherical grains: 1.0 μm, coefficient of variation of diameter of corresponding spherical grains: 25%, tabular grains, diameter/thickness ratio: 3.0) (in terms of silver) | 0.57 |
| Gelatin | 0.45 |
| ExS-4 | $3.5 \times 10^{-4}$ mo l |
| ExS-5 | $1.4 \times 10^{-4}$ mo l |
| ExS-6 | $7.0 \times 10^{-5}$ mo l |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| The ninth layer (intermediate layer) | |
| Gelatin | 0.50 |
| Solv-1 | $2.0 \times 10^{-2}$ |
| The tenth layer (the third green-sensitive emulsion layer) | |
| Silver bromoiodide emulsion (AgI 11.3 molar %, high internal AgI type, diameter of corresponding spherical grains: 1.4 μm, coefficient of variation of diameter of corresponding spherical grains: 28%, tabular grains, diameter/thickness ratio: 6.0) (in terms of silver) | 1.30 |
| Gelatin | 1.20 |
| ExS-4 | $2.0 \times 10^{-4}$ mo l |
| ExS-5 | $8.0 \times 10^{-5}$ mo l |
| ExS-6 | $8.0 \times 10^{-5}$ mo l |
| ExM-4 | $4.5 \times 10^{-2}$ |
| ExM-6 | $1.0 \times 10^{-2}$ |
| ExC-2 | $4.5 \times 10^{-3}$ |
| Cpd-5 | $1.0 \times 10^{-2}$ |
| Solv-1 | 0.25 |
| The eleventh layer (yellow filter layer) | |
| Gelatin | 0.50 |
| Cpd-6 | $5.2 \times 10^{-2}$ |
| Solv-1 | 0.12 |
| The twelfth layer (intermediate layer) | |
| Gelatin | 0.45 |
| Cpd-3 | 0.10 |

-continued

| | |
|---|---|
| The thirteenth layer (the first blue-sensitive emulsion layer) | |
| Silver bromoiodide emulsion (AgI 2 molar %, homogeneous AgI type, diameter of corresponding spherical grains: 0.55 μm, coefficient of variation of diameter of corresponding spherical grains: 25%, tabular grains, diameter/thickness ratio: 7.0) (in terms of silver) | 0.20 |
| Gelatin | 1.00 |
| ExS-7 | $3.0 \times 10^{-4}$ mo 1 |
| ExY-1 | 0.60 |
| ExY-2 | $2.3 \times 10^{-2}$ |
| Solv-1 | 0.15 |
| The fourteenth layer (the second blue-sensitive emulsion layer) | |
| Silver bromoiodide emulsion (AgI 19.0 molar %, high internal AgI type, diameter of corrsponding spherical grains: 1.0 μm, coefficient of variation of diameter of corresponding spherical grains: 16%, octahedral grains) (in terms of silver) | 0.19 |
| Gelatin | 0.35 |
| ExS-7 | $2.0 \times 10^{-4}$ mo 1 |
| ExY-1 | 0.22 |
| Solv-1 | $7.0 \times 10^{-2}$ |
| The fifteenth layer (intermediate layer) | |
| Fine silver bromoiodide grains (AgI 2 molar %, homogeneous AgI type, diameter of corresponding spherical grains: 0.13 μm) (in terms of silver) | 0.20 |
| Gelatin | 0.36 |
| The sixteenth layer (the third blue-sensitive emulsion layer) | |
| Silver bromoiodide emulsion (AgI 14.0 molar %, high internal AgI type, diameter of corresponding spherical grains: 1.7 μm, coefficient of variation of diameter of corresponding spherical grains: 28%, tabular grains, diameter/thickness ratio: 5.0) (in terms of silver) | 1.55 |
| Gelatin | 1.00 |
| ExS-8 | $1.5 \times 10^{-4}$ mo 1 |
| ExY-1 | 0.21 |
| Solv-1 | $7.0 \times 10^{-2}$ |
| The seventeenth layer (the first protecting layer) | |
| Gelatin | 1.80 |
| UV-1 | 0.13 |
| UV-28 | 0.21 |
| Solv-1 | $1.0 \times 10^{-2}$ |
| Solv-2 | $1.0 \times 10^{-2}$ |
| The eighteenth layer (the second protecting layer) | |
| Fine silver chloride grains (diameter of corresponding spherical grains: 0.07 μm) (in terms of silver) | 0.36 |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

In addition to the above-described components, 1,2-benzisothiazoline-3-on (200 ppm on average on the basis of gelatin), n-butyl-p-hydroxybenzoate (about 1,000 ppm on average on the basis of gelatin) and 2-phenoxyethanol (10,000 ppm on average on the basis of gelatin) were added to the sample prepared as described above. The sample further contained B-4, B-5, W-2, W-3, F-1, F-2, F-3, F-4, F-5, F-6, F-7, F-8, F-9, F-10, F-11, F-12, F-13 and iron salt, lead salt, gold salt, platinum salt, iridium salt and rhodium salt.

The above-described compounds were as follows:

UV-1

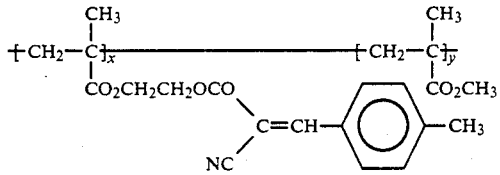

x/y = 7/3 (weight ratio)

UV-2

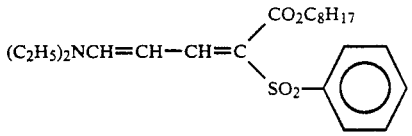

ExC-1

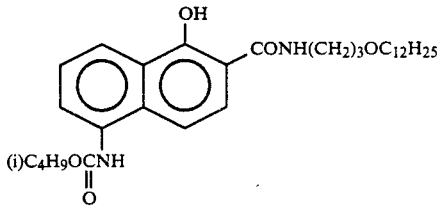

ExC-2

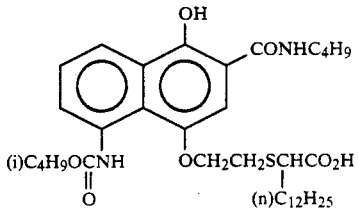

-continued
ExC-3
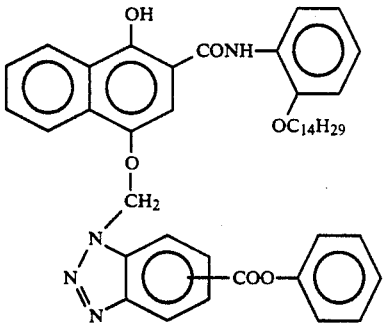
ExC-4
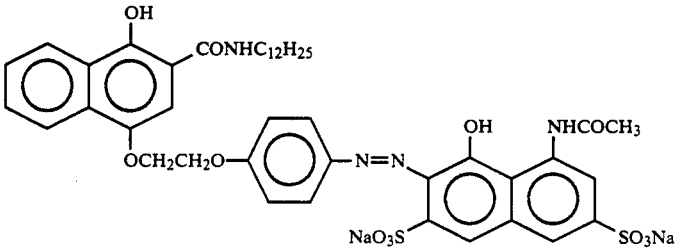
ExC-5
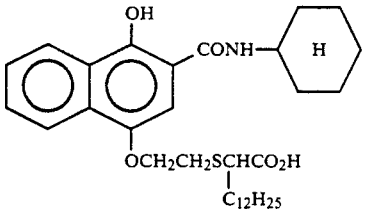
ExM-1
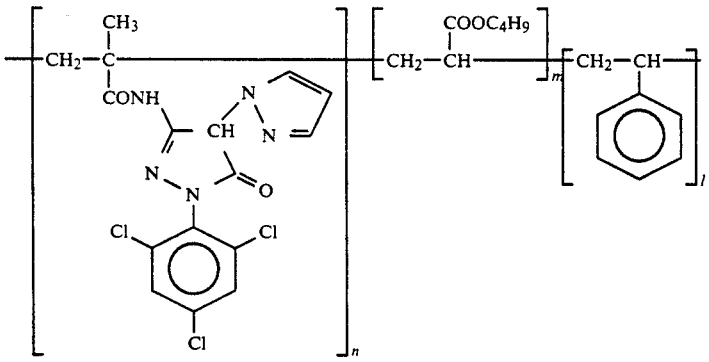
n:m:l - 2:1:1 (weight ratio)
average molecular weight: 20,000
ExM-2
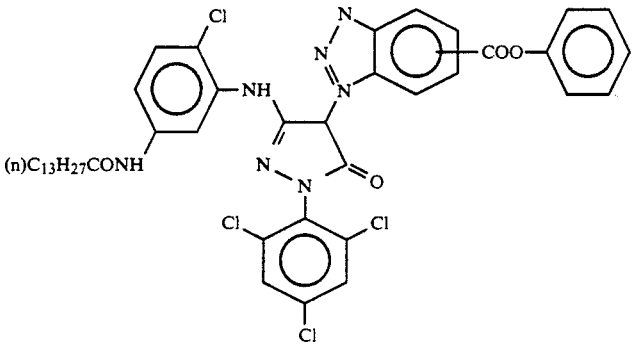

-continued
ExM-3
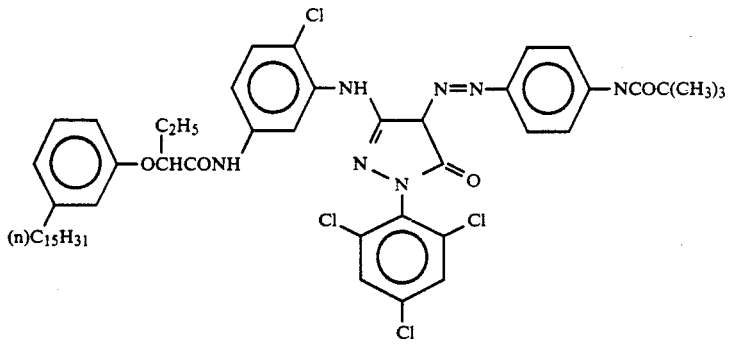
ExM-4
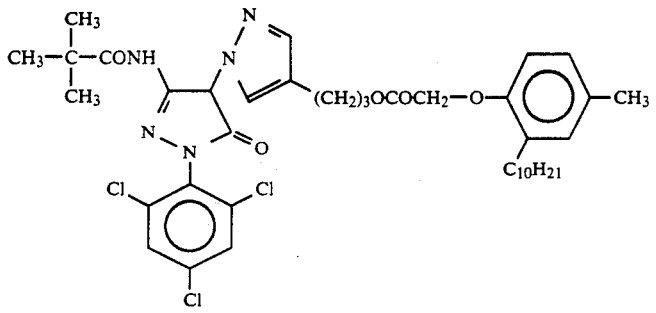
ExM-5
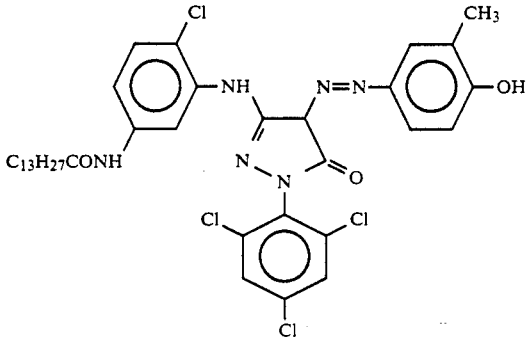
ExM-6
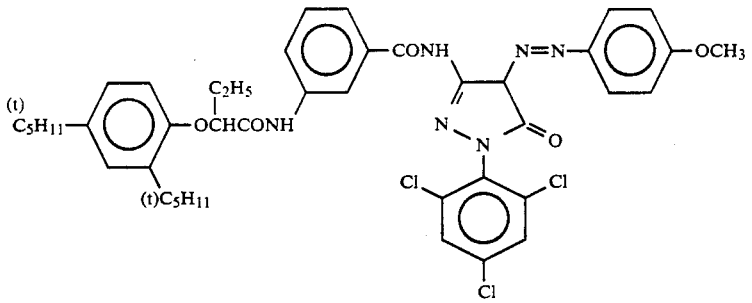
ExY-1
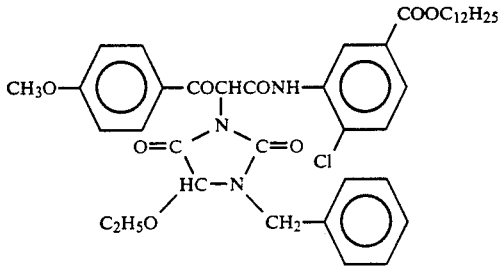

-continued
ExY-2
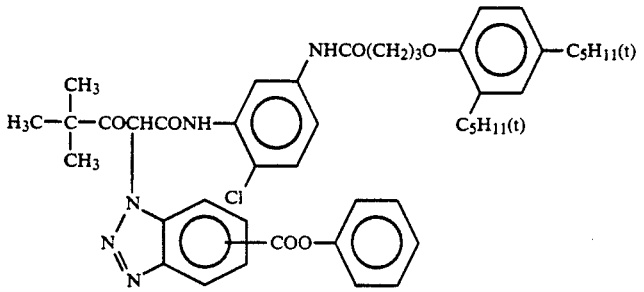
Cpd-1
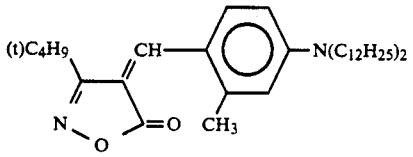
Cpd-2
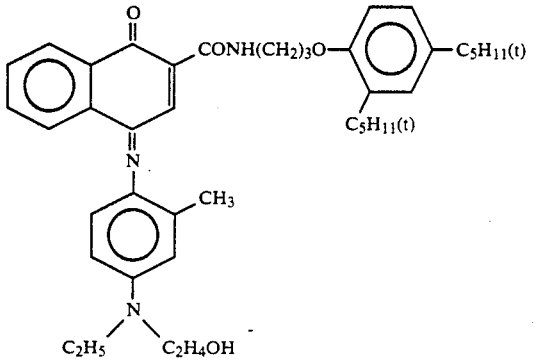
Cpd-3
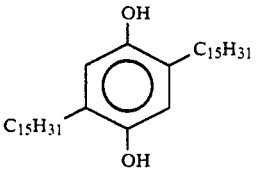
Cpd-4
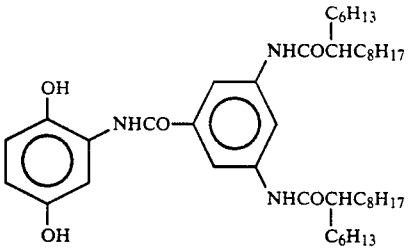
Cpd-5
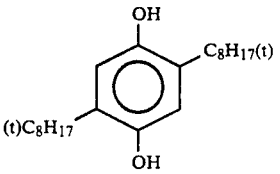
Cpd-6
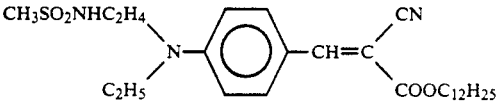

-continued
Cpd-7
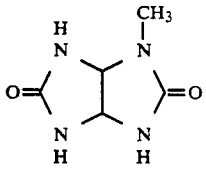
Solv-1
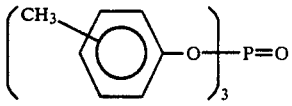
Solv-2
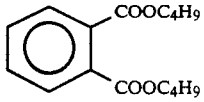
Solv-3
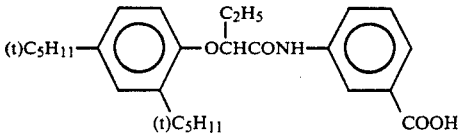
ExS-1
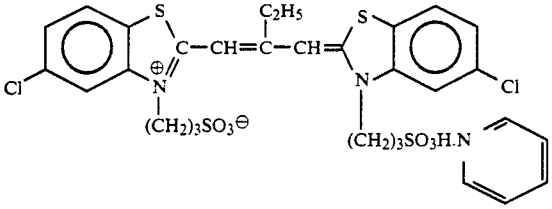
ExS-2
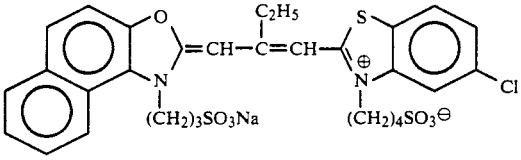
ExS-3
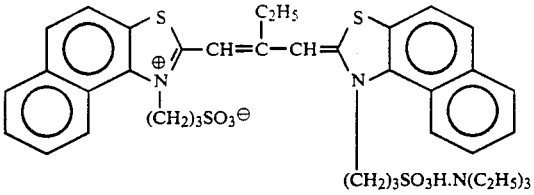
ExS-4
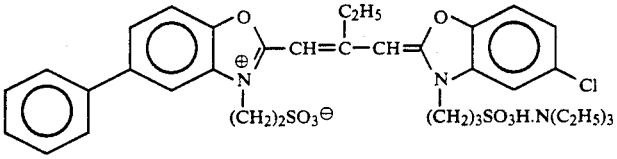
ExS-5
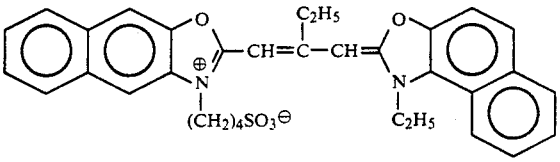

-continued
ExS-6
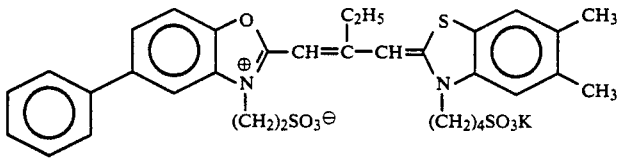
ExS-7
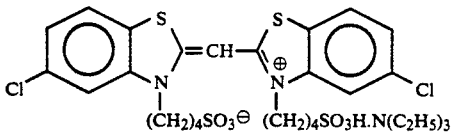
ExS-8
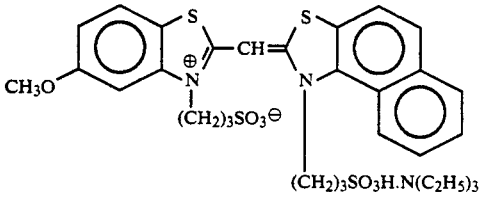
B-1
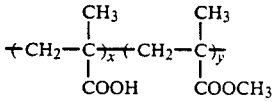
x/y = 10/90
B-2
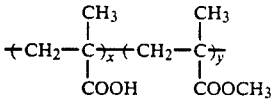
x/y = 40/60
B-3
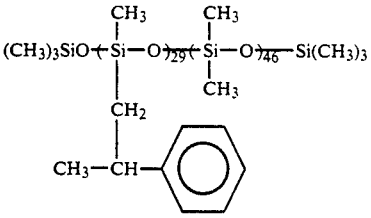
B-4
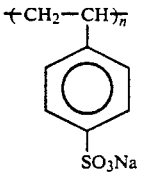
B-5
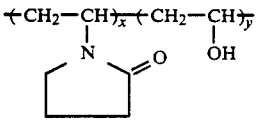
x/y = 70/30
W-1
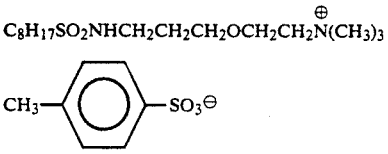
W-2
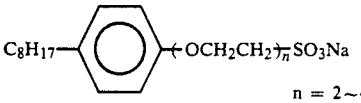
n = 2~4

-continued
W-3
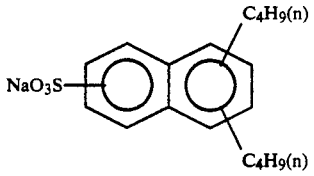
H-1
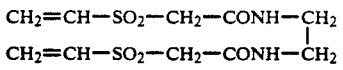
F-1
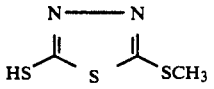
F-2
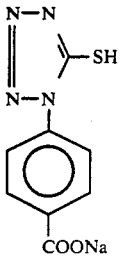
F-3
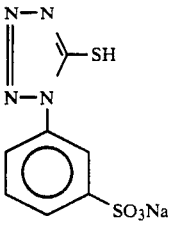
F-4
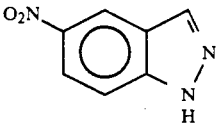
F-5
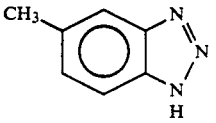
F-6
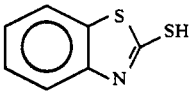
F-7
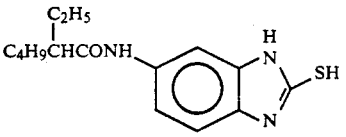
F-8
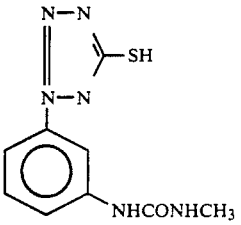

-continued

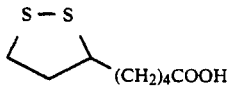

F-9

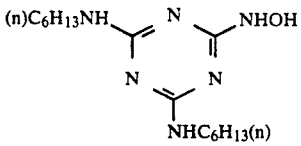

F-10

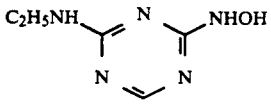

F-11

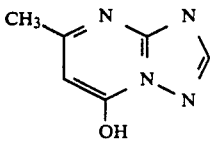

F-12

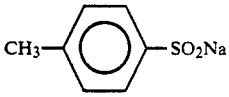

F-13

The sample prepared as described above was cut into pieces, which were subjected to an exposure to light and then to a running test with an automatic developing machine until a bleach-fixing solution had been replenished in an amount of twice as much as the tank capacity.

| Step | Temp. (°C.) | Time | Amount of replenisher* (ml) | Tank capacity (l) |
|---|---|---|---|---|
| Color development | 38.0 | 3 min 05 sec | 500 | 17 |
| Bleach-fixing (1) | 38.0 | 50 sec | — | 5 |
| Bleach-fixing (2) | 38.0 | 1 min | (1) 400 or (2) 360 | 5 |
| Washing with water | 38.0 | 30 sec | 900 | 3 |
| Stabilization (1) | 38.0 | 20 sec | — | 3 |
| Stabilization (2) | 38.0 | 20 sec | 560 | 3 |
| Drying | 80 | 60 sec | | |

*Amount of the replenisher per $m^2$ of the photosensitive material

The bleach-fixing solution and stabilizing solution were fed by countercurrent method from (2) to (1). The amounts of the developer brought into the bleach-fixing step and the bleach-fixing solution from (2) to the step of washing with water were 65 ml and 50 ml, respectively, per $m^2$ of the photosensitive material. The cross-over time was 6 sec in all the cases, which was included in the processing time of the preceding step.

The replenisher was the same as the tank solution in all the cases.

The compositions of the processing solutions were as given below.

| Color developer | Starting solution | Replenisher |
|---|---|---|
| Diethylenetriaminepentaacetic acid | 2.0 g | 2.0 g |
| 1-Hydroxyethylidene-1, 1-diphosphonic acid | 3.3 g | 3.3 g |
| Sodium sulfite | 3.9 g | 5.1 g |
| Potassium carbonate | 37.5 g | 39.0 g |
| Potassium bromide | 1.4 g | 0.4 g |
| Potassium iodide | 1.3 mg | — |
| Hydroxylamine sulfate | 2.4 g | 3.3 g |
| 2-Methyl-4-[N-ethyl-N-(β-hydroxyethyl)-amino]aniline sulfate | 4.5 g | 6.0 g |
| Water | ad 1000 ml | ad 1000 ml |
| pH (25° C.) | 10.05 | 10.05 |

| Bleach-fixing solution | Starting solution | Replenisher (1) | Replenisher (2) |
|---|---|---|---|
| Fixing agent (see Table 3) | 1.3 mol | 1.9 mol | 1.9 mol |
| Ammonium sulfite (used only when the fixing agent was ammonium thiosulfate) | 40 g | 100 g | 100 g |
| Ferric 1,3-propylenediamine-tetraacetate monohydrate (bleaching agent) | 0.12 mol | 0.18 mol | 0.18 mol |
| Chelating agent (the same as that used for bleaching agent) | 0.05 mol | 0.08 mol | 0.08 mol |
| Ammonium bromide | 80 g | 120 g | 150 g |
| Acetic acid | 40 g | 60 g | 65 g |
| Water ad | 1000 ml | 1000 ml | 1000 ml |
| pH (25° C.) (adjusted with acetic acid or ammonia) | 5.8 | 5.6 | 5.4 |

Washing water (both mother liquor and replenisher)

City water was passed through a column of mixed-bed type containing an H-type strong acidic cation exchange resin (Amberlite IR-120B; a product of Rohm & Haas Co.) and an OH-type strong basis anion exchange resin (Amberlite IRA-400; a product of Rohm & Haas Co.) to reduce both calcium and magnesium ion concentrations to 3 mg/l or below. Then 20 mg/l of sodium dichloroisocyanurate and 150 ml of sodium sulfate were added to the water. The pH of the water was in the range of 6.5 to 7.5

| Stabilizing solution | (Both starting solution and replenisher) |
|---|---|
| Sodium p-toluenesulfinate | 0.1 g |
| Polyoxyethylene-p-mononyl phenyl ether (average degree of polymerization: 10) | 0.2 g |
| Disodium ethylenediaminetetraacetate | 0.05 g |
| Formalin | 0.02 mol |
| Water | ad 1 l |
| pH (adjusted with ammonia water or acetic acid) | 7.2 |

Evaluation of desilverization power

Before completion of the running process, the amount of silver remaining in the unexposed part of the black-and-white exposed film was determined with a fluorescent X-ray analyzer.

Evaluation of stability of solution

The presence of precipitates in the washing water bath was macroscopically examined after the running process.

The criteria were as follows:

○: No precipitate was macroscopically found.

Δ: A small amount of precipitate was found.

×: A large amount of precipitate was found.

The results are given in Table 3.

TABLE 3

| Fixing agent | Replenished bleach-fixing bath | Amount of remaining silver ($\mu g/cm^2$) | Presence of precipitate in bleach-fixing (1) | Presence of precipitate in washing bath | Remarks |
|---|---|---|---|---|---|
| Ammonium thiosulfate | (1) | 13.5 | Δ to x | x | Comp. |
| | (2) | 20.3 | x | x | Ex. |
| Compound-1 | (1) | 0.6 | ○ | ○ | Present |
| | (2) | 0.8 | ○ | ○ | invention |
| Compound-2 | (1) | 0.6 | ○ | ○ | Present |
| | (2) | 0.7 | ○ | ○ | invention |
| Compound-3 | (1) | 0.5 | ○ | ○ | Present |
| | (2) | 0.6 | ○ | ○ | invention |
| Compound-9 | (1) | 0.5 | ○ | ○ | Present |
| | (2) | 0.8 | ○ | ○ | invention |
| Ammonium thiosulfate + compound-3 | (1) | 1.2 | ○ | ○ | Present |
| | (2) | 1.3 | ○ | ○ | invention |

*When ammonium thiosulfate was used in combination with compound-3, the amount of each of them was reduced to ½.

The compounds 1, 2, 3 and 9 were those therein M was H.

It is apparent from Table 3 that excellent results were obtained. Namely, when the compound of the present invention was used, no precipitation occurred even in the running process, the stability of the solution was excellent and the fixing properties were superior to those of the thiosulfate.

These effects were remarkable particularly when the amount of the replenisher was small.

Example 5

The same test as that of Example 4 was conducted except that compound-1 was replaced with compound 4, 5, 7 or 8 to obtain excellent results like those obtained in Example 4. Namely, a high fixing power was obtained and no precipitation occurred in the running process. These effects were remarkable particularly when the amount of the replenisher was small.

Example 6

The running test was conducted by using the sample of Example 4 until the fixing solution had been replenished in an amount of twice as much as the tank capacity.

| Step | Temp. (°C.) | Time | Amount of replenisher* (ml) | Tank capacity (l) |
|---|---|---|---|---|
| Color development | 38.0 | 3 min 05 sec | 600 | 17 |
| Bleaching | 38.0 | 1 min | 200 | 5 |
| Fixing | 38.0 | 1 min 20 sec | (1) 400 or (2) 360 | 5 |
| Washing with water | 38.0 | 30 sec | 900 | 3 |
| Stabilization (1) | 38.0 | 20 sec | — | 3 |
| Stabilization (2) | 38.0 | 20 sec | 560 | 3 |
| Drying | 80 | 60 sec | | |

*Amount of the replenisher per $m^2$ of the photosensitive material

The stabilizing solution was fed by countercurrent method from (2) to (1). The amounts of the developer brought into the bleaching step, the bleaching solution brought into the fixing step and the fixing solution brought into the washing step were 65 ml and 50 ml, respectively, per $m^2$ of the photosensitive material. The crossover time was 6 sec in all the cases, which was included in the processing time of the preceding step.

The replenisher was the same as the tank solution in all the cases.

The compositions of the bleaching solution and fixing solution were as shown below. The compositions of other solutions were the same as those of Example 4.

| | Starting solution | Replenisher |
|---|---|---|
| Bleaching solution | | |
| Ferric ammonium 1,3-propylenediaminetetra-acetate monohydrate | 0.30 mol | 0.45 mol |
| Ammonium bromide | 80 g | 120 g |
| Ammonium nitrate | 15 g | 25 g |
| Hydroxyacetic acid | 50 g | 75 g |
| Acetic acid | 40 g | 60 g |
| Water | ad 1000 ml | ad 1000 ml |
| pH (adjusted with ammonia water) | 4.3 | 4.0 |
| Fixing solution | | |

-continued

| | Starting solution | Replenisher |
|---|---|---|
| Fixing agent (see Table 4) | 1.3 mol | 1.9 mol |
| Ammonium sulfite (used only when the fixing agent was ammonium thiosulfate) | 40 g | 100 g |
| Imidazole | 17 g | 26 g |
| Ethylenediaminetetraacetic acid | 13 g | 20 g |
| Water | | |
| pH (adjusted with ammonia or acetic acid) | 7.0 | 7.4 |

The desilverization power and stability of the fixing solution were evaluated in the same manner as that of Example 4. The results are given in Table 4.

TABLE 4

| Fixing agent | Replenished bleaching bath | Amount of remaining silver ($\mu g/cm^2$) | Presence of precipitate in fixing bath | Presence of precipitate in water washing bath | Remarks |
|---|---|---|---|---|---|
| Ammonium | (1) | 10.8 | Δ | x | Comp. |
| thiosulfate | (2) | 15.5 | x | x | Ex. |
| Compound-1 | (1) | 0.6 | ○ | ○ | Present |
| | (2) | 0.7 | ○ | ○ | invention |
| Compound-2 | (1) | 0.5 | ○ | ○ | Present |
| | (2) | 0.6 | ○ | ○ | invention |
| Compound-3 | (1) | 0.4 | ○ | ○ | Present |
| | (2) | 0.6 | ○ | ○ | invention |
| Compound-9 | (1) | 0.4 | ○ | ○ | Present |
| | (2) | 0.6 | ○ | ○ | invention |
| Ammonium | (1) | 1.0 | ○ | ○ | Present |
| thiosulfate + compound-3 | (2) | 1.2 | ○ | ○ | invention |

*When ammonium thiosulfate was used in combination with compound-3, the amount of each of them was reduced to ½.
The compounds 1, 2, 3 and 9 were those wherein M was H.

It is apparent from Table 4 that excellent results were obtained in the evaluation of the desilverization and stability of the fixing solution according to the present invention.

These effects were remarkable particularly when the amount of the replenisher was small.

Example 7

(1) Preparation of tabular grains

Preparation of emulsion 5 g of potassium bromide, 0.05 g of potassium iodide, 30 g of gelatin and 2.5 ml of 5% aqueous solution of a thioether $HO(CH_2)_2S(CH_2)_2OH$ were added to 1 liter of water. An aqueous solution of 8.33 g of silver nitrate and an aqueous solution containing 5.94 g of potassium bromide and 0.726 g of potassium iodide were added to that solution kept at 73° C. by double jet method. The addition time was 45 sec. 2.5 g of potassium bromide was added to the resultant mixture and then an aqueous solution containing 8.33 g of silver nitrate was added thereto for a period of 26 min in such a manner that the quantity of the flow at the completion of the addition would be twice as much as that at the time of initiation of the addition.

20 ml of 25% ammonia solution and 10 ml of 50% $NH_4NO_3$ were added to the reaction product. After physical aging for 20 min, 240 ml of 1N sulfuric acid was added to the mixture to neutralize it. Then an aqueous solution of 153.34 g of silver nitrate and an aqueous potassium bromide solution were added to the mixture by controlled double jet method for a period of 40 min while the potential was kept at pAg 8.2. In this step, the flow rate was accelerated so that the quantity of the flow at the completion of the addition was nine times as much as that at the time of initiation of the addition. After completion of the addition, 15 ml of 2N potassium thiocyanate solution was added to the resultant mixture and then 25 ml of 1% aqueous potassium iodide solution was added to the solution for a period of 30 sec. Then the temperature was lowered to 35° C., soluble salts were removed by precipitation method. The resultant mixture was heated at 40° C., to which 30 g of gelatin and 2 g of phenol were added. The mixture was adjusted to pH 6.40 and pAg 8.10 with sodium hydroxide and potassium bromide.

After elevating the temperature to 56° C., 600 mg of a sensitizing dye having a structure which will be given below and 150 mg of a stabilizer having a structure which will be also given below were added to the resultant product. Ten minutes after, 2.4 mg of sodium thiosulfate pentahydrate, 140 mg of potassium thiocyanate and 2.1 mg of chloroauric acid were added to each emulsion. 80 minutes after, the emulsion was solidified by rapid cooling. In the resultant emulsion, 98% of the total projected surface area of all the grains comprised the projected surface area of grains having an aspect ratio of at least 3. The average diameter of the projected area of all the grains having an aspect ratio of 2 or above was 1.4 μm, and the standard deviation, average thickness and aspect ratio of them were 22%, 0.187 μm and 7.5, respectively.

Sensitizing dye

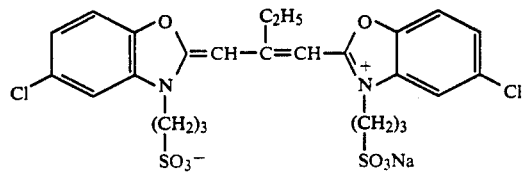

Stabilizer

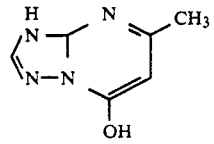

Preparation of emulsion for coating

The following chemicals (per mol of the silver halide) were added to the emulsion to prepare a coating emulsion:

| | |
|---|---|
| Gelatin | such an amount that Ag/(gelatin + polymer) weight ratio would be 1.10 |
| Water-soluble polyester | 20 wt. % (based on gelatin) |
| Polymer latex [poly(ethyl acrylate/methacrylic acid = 97/3)] | 25.0 g |
| Hardener 1,2-Bis(vinylsulfonyl-acetamido)ethane | 8 mmol/100 g of gelatin in emulsion layer of surface-protecting layer |
| Phenoxyethanol | 2 g |
| 2,6-Bis(hydroxyamino)-4-diethylamino-1,3,5-triazine | 80 mg |
| Polysodium acrylate (average molecular weight: 41,000) | 4.0 g |
| Polypotassium styrenesulfonate (average molecular weight: 600,000) | 1.0 g |

Preparation of photosensitive material A

The coating emulsion prepared as described above was applied to a transparent PET support having a thickness of 175 μm together with a coating emulsion for forming a surface-protecting layer.

The total amount of silver applied in both layers was 3.2 g/m$^2$.

The composition of the emulsion for forming the surface-protecting layer was as follows:

| Composition of surface-protecting layer: | Amount |
|---|---|
| Gelatin | 1.15 g/m$^2$ |
| Polyacrylamide (average molecular wt. 45,000) | 0.25 g/m$^2$ |
| Polysodium acrylate (average molecular wt. 400,000) | 0.02 g/m$^2$ |
| Sodium p-t-octylphenoxydiglycerylbutylsulfonate | 0.02 g/m$^2$ |
| Poly(degree of polymerization: 10)oxyethylene cetyl ether | 0.035 g/m$^2$ |
| Poly(degree of polymerization: 10)oxyethylene/poly(degree of polymerization: 3)oxyglyceryl p-octylphenoxy ether | 0.01 g/m$^2$ |
| 2-Chlorohydroquinone | 0.046 g/m$^2$ |
| $C_8F_{17}SO_3K$ | 0.003 g/m$^2$ |
| $C_8F_{17}SO_2N(C_3H_7)(CH_2-CH_2O)_4(CH_2)_4SO_3Na$ | 0.001 g/m$^2$ |
| $C_8F_{17}SO_2N(C_3H_7)(CH_2CH_2O)_{15}H$ | 0.003 g/m$^2$ |
| Proxel (1,2-Benzisothiazoline-3-one) | 0.001 g/m$^2$ |
| Polymethyl methacrylate (average grain diameter: 3.5 μm) | 0.025 g/m$^2$ |
| Poly(methyl methacrylate/methacrylate) (molar ratio: 7:3, average grain diameter: 2.5 μm) | 0.020 g/m$^2$ |

(2) Preparation of potato-like grains

Preparation of emulsion 20 g of gelatin, 30 g of potassium bromide and 3.91 g of potassium iodide were added to 900 ml of water in a vessel kept at 48° C., to which 35 g of silver nitrate in the form of an aqueous solution thereof was added for a period of 4 min.

Then ammoniac silver nitrate (165 g in terms of silver nitrate) and an aqueous potassium bromide solution were added at the same time to the resultant mixture by double jet method for a period of 5 min. After completion of the addition, soluble salts were removed by precipitation method at 35° C. The resultant mixture was heated at 40° C., to which 100 g of gelatin was added and pH was adjusted to 6.7. The grains in the resultant emulsion were in a potato-like form. The average diameter of spheres having the same volume as that of the respective grains was 0.82 μm. The silver iodide content was 2 molar %. The emulsion was chemically sensitized by combination of gold sensitization method and sulfur sensitization method.

Preparation of photosensitive material B

An aqueous gelatin solution containing polyacrylamide having an average molecular weight of 8,000, polysodium styrenesulfonate, fine polymethyl methacrylate particles (average particle size: 3.0 μm), polyethylene oxide, a hardener, etc. in addition to gelatin was used as a solution for forming the surface-protecting layer.

500 mg/mol-Ag of sodium anhydro-5,5'-dichloro-9-ethyl-3,3'-di(sulfopropyl)oxacarboxyanine hydroxide and 200 mg/mol-Ag of potassium iodide were added as sensitizing dyes to the emulsion prepared as described above. 4-Hydroxy-6-methyl-1,3,3a,7-tetrazaindene, 2,6-bis(hydroxyamino)-4-diethylamino-1,3,5-triazine and nitron as stabilizers, trimethylolpropane as dry fogging inhibitor, a coating assistant and a hardener were added to the resultant mixture to form a coating emulsion, which was then applied to the both surfaces of a polyethylene terephthalate support together with a surface-protecting layer-forming emulsion. After drying, photosensitive material B was obtained. The total amount of silver applied to the both surfaces of the photosensitive material was 6.4 g/m$^2$.

| Development process: Preparation of concentrated solutions: | |
|---|---|
| <Developer> | |
| Part A | |
| Potassium hydroxide | 330 g |
| Potassium sulfite | 630 g |
| Sodium sulfite | 240 g |
| Potassium carbonate | 90 g |
| Boric acid | 45 g |
| Diethylene glycol | 180 g |
| Diethylenetriaminepentaacetic acid | 30 g |
| 1-(Diethylaminoethyl)-5-mercaptotetrazole | 0.75 g |
| Hydroquinone | 450 g |
| Water ad | 4125 ml |
| Part B | |
| Diethylene glycol | 525 g |
| Glacial acetic acid | 102.6 g |
| 5-Nitroindazole | 3.75 g |
| 1-Phenyl-3-pyrazolidone | 34.5 g |
| Water ad | 750 ml |
| Part C | |
| Glutaraldehyde (50 wt/wt %) | 150 g |
| Potassium metabisulfite | 150 g |
| Potassium bromide | 15 g |
| Water ad | 750 ml |
| <Fixing solution> | |
| Ammonium thiosulfate (70 wt/vol %) or fixing agent of the present invention | 1.0 mol |
| Disodium ethylenediaminetetraacetate dihydrate | 0.03 g |
| Sodium sulfite (used only when ammonium thiosulfate was used) | 20 g |
| Boric acid | 4 g |
| 1-(N,N-Dimethylamino)-ethyl-5-mercaptotetrazole | 1 g |
| Tartaric acid | 3.2 g |
| Glacial acetic acid | 45 g |
| Sodium hydroxide | 15 g |

-continued

| Development process: Preparation of concentrated solutions: | |
|---|---|
| Sulfuric acid (36 N) | 3.9 g |
| Aluminum sulfate | 10 g |
| Water ad | 400 ml |
| pH | 4.68 |

Preparation of processing solutions

Each part of the concentrated developer was fed into a polyethylene vessel. The vessels containing parts A, B and C, respectively, were connected to each other.

The above-described concentrated fixing solution was also fed into a polyethylene vessel.

The concentrated developer prepared as described above was kept at 50° C. in the vessel for 3 months and then used for preparing the developer.

A developing tank and fixing tank of an automatic developing machine were filled with the developer and fixing solution, respectively, with a quantitative pump of that machine in a proportion described below.

Developer (pH 10.50)

55 ml of Part A, 10 ml of Part B, 10 ml of Part C and 125 ml of water were mixed together to form the developer.

Fixing solution (pH 4.65)

80 ml of the concentrated fixing solution was mixed with 120 ml of water to form the fixing solution.

A tank for washing with water was filled with city water. Four non-woven fabric bags each containing 50 g of a slow silver releaser which was a soluble glass comprising $Na_2O/B_2O_5/SiO_2$ (weight ratio: 10/65/25) containing 1.7% by weight of $Ag_2O$ were 50 g were placed at the bottom of the tank.

The photosensitive materials A and B were cut into pieces, which were exposed to X-ray to an extent of 50% and then subjected to the running test with an automatic developing machine until the fixing solution had been replenished in an amount of twice as much as the tank capacity.

| Step | Temp. (°C.) | Time | Amount of replenisher* (ml) | Tank capacity (l) |
|---|---|---|---|---|
| Development | 35 | 13.3 sec | 45 | 15 |
| Fixing | 32 | 10.5 sec | 30 or 20 | 15 |
| Washing with water | 18 | 5.7 sec | | 13 |

*Amount per sheet of a size of 10 × 12 inch.

The flow rate of the water for washing was 5 l/min in the process (2) and 10 l/min in the process (1). The water was fed (about 1 l/sheet of a size of 10×12 inch) by opening a magnetic valve while the photosensitive material was processed. After completion of the process every day, the magnetic valve was automatically opened to completely drain the water from the tank. A means for washing the cross over rollers by automatically applying washing water to them between the devlopment step and fixing step and between the fixing step and washing step with water was provided (a method described in Japanese Patent Application No. Sho 61-131338).

Evaluation of desilverization power

Before completion of the running process, the amount of silver remaining in the unexposed part of the processed film was determined with a fluorescent X-ray analyzer.

Evaluation of stability of solution

The presence of precipitates in the fixing bath was macroscopically examined after the running process.

The criteria were as follows:

○: No precipitate was macroscopically found.

Δ: A small amount of precipitate was found.

×: A large amount of precipitate was found.

The results are given in Tables 5 and 6.

TABLE 5

(Photosensitive material A)

| Fixing agent | Replenished fixing bath | Amount of remaining silver ($\mu g/cm^2$) | Presence of precipitate in fixing bath | Remarks |
|---|---|---|---|---|
| Ammonium thiosulfate | (1) | 10.3 | Δ | Comp. |
| | (2) | 15.2 | x | Ex. |
| Compound-1 | (1) | 0.6 | ○ | Present |
| | (2) | 0.8 | ○ | invention |
| Compound-2 | (1) | 0.5 | ○ | Present |
| | (2) | 0.7 | ○ | invention |
| Compound-3 | (1) | 0.4 | ○ | Present |
| | (2) | 0.5 | ○ | invention |
| Compound-9 | (1) | 0.5 | ○ | Present |
| | (2) | 0.6 | ○ | invention |
| Ammonium thiosulfte + compound-3 | (1) | 0.9 | ○ | Present |
| | (2) | 1.1 | ○ | invention |

*When ammonium thiosulfate was used in combination with compound-3, the amount of each of them was reduced to ½.

The compounds 1, 2, 3 and 9 were those wherein M was H.

TABLE 6

(Photosensitive material B)

| Fixing agent | Replenished fixing bath | Amount of remaining silver ($\mu g/cm^2$) | Presence of precipitate in fixing bath | Remarks |
|---|---|---|---|---|
| Ammonium thiosulfate | (1) | 9.2 | Δ | Comp. |
| | (2) | 12.1 | x | Ex. |
| Compound-1 | (1) | 0.6 | ○ | Present |
| | (2) | 0.7 | ○ | invention |
| Compound-2 | (1) | 0.5 | ○ | Present |
| | (2) | 0.7 | ○ | invention |
| Compound-3 | (1) | 0.4 | ○ | Present |
| | (2) | 0.5 | ○ | invention |
| Compound-9 | (1) | 0.4 | ○ | Present |
| | (2) | 0.6 | ○ | invention |
| Ammonium thiosulfate + compound-3 | (1) | 0.8 | ○ | Present |
| | (2) | 1.0 | ○ | invention |

*When ammonium thiosulfate was used in combination with compound-3, the amount of each of them was reduced to ½.

The compounds 1, 2, 3 and 9 were those wherein M was H.

It is apparent from Tables 5 and 6 that excellent results were obtained. Namely, when the compound of the present invention was used, no precipitation occurred even in the running process, the stability of the solution was excellent and the fixing properties were superior to those of the thiosulfate.

These effects were remarkable particularly when the amount of the replenisher was small.

In cases where the compounds 1, 2, 3 and 9 each was replaced by its sodium salt, the same results mentioned above were obtained.

Example 8

The same test as that of Example 7 was conducted except that compound-1 was replaced with compound 4, 5 or 8 to obtain excellent results like those obtained in Example 7. Namely, a high fixing power was obtained and no precipitation occurred in the running process. These effects were remarkable particularly when the amount of the replenisher was small.

Example 9

A silver chlorobromoiodide emulsion (bromine content: 30 molar %, iodine content: 0.1 molar %) was prepared by precipitating silver halide grains by double jet method followed by physical aging, desalting and chemical aging. The silver halide grains contained in the emulsion had an average diameter of 0.3 μm. 1 kg of the emulsion contained 0.6 mol of silver halide.

A 1 kg portion of the emulsion was taken and heated to 40° C. to obtain a solution. 70 ml of 0.05 wt. % solution of a sensitizing dye (9-1) given below in methanol was added to the solution and then a predetermined amount of an aqueous sodium bromide solution was added to the resultant mixture. Then 25 ml of 1.0 wt. % solution of compound (9-2) in methanol and 50 ml of 0.5 wt. % solution of compound (9-3) in methanol were added to the mixture. Further 30 ml of 1.0 wt. % aqueous sodium 1-hydroxy-3,5-dichlorotriazine solution and then 40 ml of 1.0 wt. % aqueous sodium dodecylbenzenesulfonate were added to the resultant mixture. The mixture thus obtained was stirred to obtain an emulsion, which was applied to a cellulose triacetate film base so that the thickness of the coating film thus formed would be 5 μm after drying. Thus a sample of the photosensitive material was obtained.

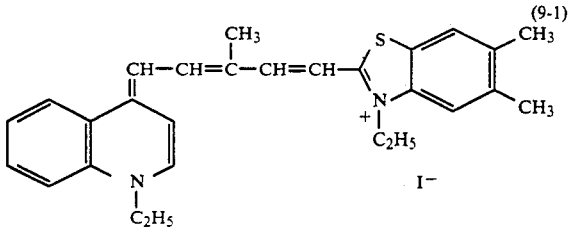

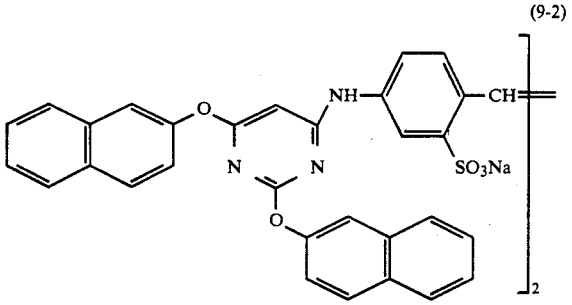

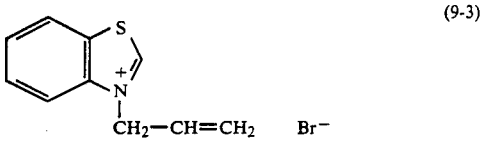

The sample prepared as described above was cut into pieces, which were subjected to black-and-white exposure and then to a running test comprising the following steps until the fixing solution had been replenished in an amount of twice as much as the tank capacity.

| Step | Processing steps: Time (sec) | Temp. (°C.) | Amount of replenisher (ml) | Tank capacity (l) |
|---|---|---|---|---|
| Development | 20 | 38 | 320 | 18 |
| Fixing | 12 | 38 | (1) 300<br>(2) 200 | 18 |
| Washing with water | 20 | 20 | 2000 | 18 |

The amount of replenisher is given per $m^2$ of the photosensitive material.

TABLE 7

| | Mother liquor = replenisher |
|---|---|
| (Developer) | |
| Metol | 0.31 g |
| Anhydrous sodium sulfite | 39.6 g |
| Hydroquinone | 6.0 g |
| Anhydrous sodium carbonate | 18.7 g |
| Potassium bromide | 0.86 g |
| Citric acid | 0.68 g |
| Potassium metabisulfite | 1.5 g |
| Water ad | 1 l |
| (Fixing solution) | |
| Ammonium thiosulfate | 200 ml |
| or N-oxide compound | 1 mol |
| Sodium hydrogensulfite | 12.0 g |
| Disodium ethylenediaminetetraacetate | 0.1 g |
| Tartaric acid | 3.0 g |
| Ammonia water (27%) | 7.0 g |
| Acetic acid (90%) | 20.0 g |
| Aluminum sulfate (27%) | 35.0 g |

Water was added to make the total fixing solution 1 l. The fixing solution to be used under the replenishing condition (1) was adjusted to pH 4.2 and that to be used under the replenishing condition (2) was adjusted to pH 4.0 with sodium hydroxide.

Evaluation of desilverization power

After completion of the running process, amount of silver remaining in the unexposed part of the processed film was determined with a fluorescent X-ray analyzer.

Evaluation of stability of solution

The presence of precipitates in the fixing bath was macroscopically examined after the running process.

The criteria were as follows:

○: No precipitate was macroscopically found.

Δ: A small amount of precipitate was found.

×: A large amount of precipitate was found.

The results are given in Table 8.

TABLE 8

| Fixing agent | Replenished fixing bath | Amount of remaining silver (μg/cm²) | Presence of precipitate in fixing bath | Remarks |
|---|---|---|---|---|
| Ammonium | (1) | 8.3 | Δ | Comp. |
| thiosulfate | (2) | 12.1 | x | Ex. |
| Compound-1 | (1) | 0.7 | ○ | Present |
| | (2) | 0.8 | ○ | invention |
| Compound-2 | (1) | 0.6 | ○ | Present |
| | (2) | 0.8 | ○ | invention |
| Compound-3 | (1) | 0.5 | ○ | Present |
| | (2) | 0.8 | ○ | invention |
| Compound-9 | (1) | 0.5 | ○ | Present |
| | (2) | 0.7 | ○ | invention |
| Ammonium | (1) | 0.3 | ○ | Present |
| thiosulfate + | (2) | 0.5 | ○ | invention |

TABLE 8-continued

| Fixing agent | Replenished fixing bath | Amount of remaining silver ($\mu g/cm^2$) | Presence of precipitate in fixing bath | Remarks |
|---|---|---|---|---|
| compound-3 | | | | |

*When ammonium thiosulfate was used in combination with compound-3, the amount of each of them was reduced to ½.

The compounds 1, 2, 3 and 9 were those wherein M was H.

It is apparent from Table 8 that excellent results were obtained. Namely, when the N-oxide compound was used, no precipitation occurred even in the running process, the stability of the solution was excellent and the fixing properties were superior to those of the thiosulfate.

These effects were remarkable particularly when the amount of the replenisher was small.

Example 10

The same test as that of Example 9 was conducted except that compound-1 was replaced with compound 4, 5 or 8 to obtain excellent results like those obtained in Example 9. Namely, a high fixing power was obtained and no precipitation occurred in the running process. These effects were remarkable particularly when the amount of the replenisher was small.

By using these compounds, the solution having a stable fixing power and an excellent desilverizing properties could be obtained. Further even when the color photosensitive material was fixed with a small amount of the replenisher, the excellent process was also possible.

What is claimed is:

1. A method for processing a silver halide photosensitive material which comprises the steps of developing an exposed silver halide photosensitive material and treating it with a bath having a fixing function containing an N-oxide compound having a mercapto group in the molecule.

2. The method of claim 1 wherein the N-oxide compound is represented by the following formula (1):

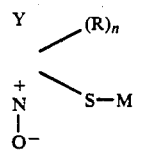

wherein M represents a hydrogen atom, an alkali metal, an alkaline earth metal or an ammonium group, Y represents an atomic group necessitated for forming a five- to seven-membered heterocyclic ring, R represents a substituent and n represents an integer of 0 to 5.

3. The method of claim 2 wherein R represents a halogen atom, an alkyl, hydroxyl, alkoxy, amino, carbonamido, sulfonamido, ureido, thioureido, acyl, carbamoyl, sulfamoyl, oxycarbonyl, carboxyl, sulfonyl, cyano, nitro, aryl, aralkyl, alkenyl, acyloxy, sulfonyloxy, oxycarbonylamino or sulfonic group.

4. The method of claim 3 wherein R represents a carboxyl group, a sulfonic group, an amino group and a group having such a group and n represents 0 or 1.

5. The method of claim 4 wherein n is 1 and R is a carboxyl group or sulfonic group.

6. The method of claim 5 wherein M represents a hydrogen atom or an alkali metal.

7. The method of claim 2 wherein the N-oxide compound has 3 to 20 carbon atoms.

8. The method of claim 1 wherein the bath having a fixing function is a fixing bath.

9. The method of claim 8 wherein the fixing bath contains the N-oxide compound in an amount of $1\times10^{-4}$ to 10 mol/l.

10. The method of claim 9 wherein an amount of fixing solution to be replenished is 800 ml or below relative to $m^2$ of the treated silver halide photosensitive materials.

11. The method of claim 9 wherein the silver halide phosensitive material is treated with the fixing bath at a temperature of 20° to 50° C. for 20 sec to 5 min.

12. The method of claim 1 wherein the bath having a fixing function is a bleach fixing bath.

13. The method of claim 12 wherein the bleach-fixing bath contains the N-oxide compound in an amount of $2\times10^{-2}$ to 10 mol/l.

14. The method of claim 13 wherein an amount of bleach-fixing solution to be replenished is 500 ml or below relative to $m^2$ of the treated silver halide photosensitive materials.

15. The method of claim 13 wherein the silver halide phosensitive material is treated with the bleach-fixing bath at a temperature of 20° to 50° C. for 20 sec to 5 min.

* * * * *